US010753033B2

(12) United States Patent
Kim et al.

(10) Patent No.: US 10,753,033 B2
(45) Date of Patent: Aug. 25, 2020

(54) LAUNDRY HANDLING APPARATUS

(71) Applicant: LG Electronics Inc., Seoul (KR)

(72) Inventors: Myoungjong Kim, Seoul (KR); Seongwoo An, Seoul (KR); Semin Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 13 days.

(21) Appl. No.: 15/932,343

(22) PCT Filed: Aug. 18, 2016

(86) PCT No.: PCT/KR2016/009064
§ 371 (c)(1),
(2) Date: Feb. 16, 2018

(87) PCT Pub. No.: WO2017/030378
PCT Pub. Date: Feb. 23, 2017

(65) Prior Publication Data

US 2018/0230639 A1 Aug. 16, 2018

(30) Foreign Application Priority Data

Aug. 18, 2016 (KR) ..... 10-2015-0116218

(51) Int. Cl.
*D06F 58/45* (2020.01)
*D06F 58/22* (2006.01)
(Continued)

(52) U.S. Cl.
CPC ..... *D06F 58/22* (2013.01); *D06F 25/00* (2013.01); *D06F 58/24* (2013.01)

(58) Field of Classification Search
CPC ..... D06F 58/22; D06F 58/00; F26B 21/03; F26B 25/007
(Continued)

(56) References Cited

U.S. PATENT DOCUMENTS 5,384,982 A * 1/1995 Galperin ..... F16P 3/12 200/61.43
10,280,552 B2 * 5/2019 Kulkarni ..... D06F 58/22
(Continued)

FOREIGN PATENT DOCUMENTS

JP H06098993 4/1994
JP H06277397 10/1994
(Continued)

OTHER PUBLICATIONS

Extended European Search Report in European Application No. 16837320.7, dated Feb. 22, 2019, 9 pages.

*Primary Examiner* — John P McCormack
(74) *Attorney, Agent, or Firm* — Fish & Richardson P.C.

(57) ABSTRACT

The present invention relates to a laundry handling apparatus provided with a washable filter in an air circulation passage for drying laundry. The laundry handling apparatus according to the present invention comprises: a cabinet, an outer tub disposed inside the cabinet, an inner tub rotatably disposed inside the outer tub, a circulation passage for guiding at least some of the air inside the outer tub to flow out of the outer tub and be resupplied to the outer tub, a fan disposed in the circulation passage so as to move the air, and a filter unit for filtering foreign substances. The filter unit comprises a filter net, which is disposed in the circulation passage so as to collect the foreign substances contained in the moving air, and a filter frame for supporting the filter net. The laundry handing apparatus comprises: multiple nozzles for spraying wash water onto a partial area of the filter net, a nozzle disposition unit, which is disposed in a position spaced apart from the filter net and has the multiple nozzles arranged therein, a nozzle water supply hose, which is connected to the nozzle disposition unit so as to supply the wash water, which is sprayed by the multiple nozzles, and a filter driving unit for allowing the filter unit and the nozzle
(Continued)

disposition unit to move relative to one another so that the wash water is sprayed onto the entire area of the filter net.

15 Claims, 15 Drawing Sheets

(51) Int. Cl.
*D06F 25/00* (2006.01)
*D06F 58/24* (2006.01)

(58) Field of Classification Search
USPC ..... 34/292, 300, 480, 82, 261
See application file for complete search history.

(56) References Cited

U.S. PATENT DOCUMENTS

| | | | | |
|---|---|---|---|---|
| 2011/0271542 | A1* | 11/2011 | Ko | D06F 58/22 |
| 2017/0159218 | A1* | 6/2017 | Zhu | D06F 29/02 |
| 2018/0044845 | A1* | 2/2018 | Bocchino | D06F 58/22 |
| 2019/0093279 | A1* | 3/2019 | Grider | D06F 58/22 |

FOREIGN PATENT DOCUMENTS

| | | |
|---|---|---|
| KR | 1020070075596 | 7/2007 |
| KR | 101191209 | 10/2012 |
| KR | 1020140039248 | 4/2014 |
| KR | 1020150039480 | 4/2015 |

* cited by examiner

LAUNDRY HANDLING APPARATUS

CROSS-REFERENCE TO RELATED APPLICATIONS

This application is a National Stage application under 35 U.S.C. § 371 of International Application No. PCT/KR2016/009064, filed Aug. 18, 2016, which claims the benefit of Korean Application No. 10-2015-0116218, filed on Aug. 18, 2015. The disclosures of the prior applications are incorporated by reference in their entirety.

TECHNICAL FIELD

The present invention relates to a laundry handling apparatus capable of drying laundry, and more particularly to a laundry handling apparatus provided with a washable filter in an air circulation passage for drying laundry.

BACKGROUND ART

In general, a laundry treatment apparatus includes a cabinet, an outer tub disposed inside the cabinet, and an inner tub rotatably disposed inside the outer tub.

A laundry treatment apparatus capable of drying laundry supplies heated air (hot wind) to laundry. A dry system is classified into an exhaust type dry system for exhausting air to the outside, a circulation type dry system for adjusting a temperature and humidity of the air to resupply the adjusted air to laundry, and a hybrid type dry system for exhausting some of the air and resupplying remaining air to laundry according to how to treat air having increased humidity by making contact with the laundry.

A laundry treatment apparatus including the circulation type dry system or the hybrid type dry system includes a circulation passage for guiding at least some of air inside the outer tub to flow out of the outer tub and be resupplied to the outer tub.

Foreign substances separated from laundry are included in air moving through the circulation passage. In particular, if the inner tub is rotated during a drying stroke, friction occurs in the laundry so that an amount of the foreign substances is further increased. In this case, the foreign substances adhere to a temperature and humidity controller included in the circulation passage so that failure of the temperature and humidity controller may occur or the efficiency may be deteriorated, and foreign substances in air resupplied into the outer tub may adhere to the laundry.

In order to solve the above problems, the related art provides a filter disposed on the circulation passage to filter out the foreign substances. The filter includes a filter net and the filter net functions to collect foreign substances. The relater art includes a nozzle for spraying cleaning water to automatically remove the foreign substances collected in the filter net.

DISCLOSURE

Technical Problem

In the related art, if the wash water passes through the filter net by directly spraying the wash water to the filter net, it is easy to remove foreign substances collected in a part of the filer net colliding with the wash water. However, since the wash water passes through the filter net, it difficult to remove the foreign substances collected in a remaining part of the filter net. A first objective is aimed at solving the above problem.

In the related art, if the wash water flows through the filter net by spraying the wash water around the filter net, it is easy to supply the wash water to a wide area of the filter net. Since a flow rate of flowing wash water is lower than a flow rate of the sprayed wash water, although the wash water is supplied, foreign substances collected in the filter net may not be easily removed. A second objective is aimed at solving the above problem.

A third objective is to minimize the number of nozzles while directly spraying wash water to the entire area of the filter net.

In the related art, the nozzle and the filter are fixed. In this case, it is difficult to uniformly supply the sprayed wash water to the entire area of the filter net due to a deviation of a spray angle of the nozzle and a deviation of water pressure. A fourth objective is aimed at solving the above problem.

In the related art, when the foreign substances adhere to the filter net, although the wash water is sprayed to the filter net, the foreign substances are not easily removed. A fifth objective is aimed at solving the above problem.

A sixth objective is aimed at easily draining the wash water sprayed to the filter net and the removed foreign substances.

The above information disclosed in this background section is only for enhancement of understanding of the background of the invention and therefore it may contain information that does not form the prior art that is already known in this country to a person of ordinary skill in the art.

Technical Solution

In order to achieve the above objectives, a laundry handling apparatus according to the present invention includes: a cabinet; an outer tub disposed inside the cabinet; an inner tub rotatably disposed inside the outer tub; a circulation passage for guiding at least some of the air inside the outer tub to flow out of the outer tub and be resupplied to the outer tub, a fan disposed in the circulation passage so as to move the air; a filter unit for filtering foreign substances.

The filter unit includes a filter net, which is disposed in the circulation passage so as to collect the foreign substances contained in the moving air, and a filter frame for supporting the filter net.

The laundry handling apparatus includes multiple nozzles for spraying wash water onto a partial area of the filter net; a nozzle disposition unit, which is disposed in a position spaced apart from the filter net and has the multiple nozzles arranged therein; a nozzle water supply hose, which is connected to the nozzle disposition unit so as to supply the wash water, which is sprayed by the multiple nozzles; and a filter driving unit for allowing the filter unit and the nozzle disposition unit to move relative to one another so that the wash water is sprayed onto the entire area of the filter net.

The plurality of nozzles is disposed in a direction to traverse a track of the relative motion in order to spray the wash water to the entire area of the filter net according to the relative motion.

In order to guide a flow direction of the wash water capable of easily washing the foreign substances, the nozzle disposition unit may be disposed at a lower side with respect to the filter net.

In order to guide a flow direction of the wash water capable of easily washing the foreign substances and to easily drain the used wash water and foreign substances included in the wash water, the present invention presents disposition relationship between the filter net, the nozzle disposition unit, and the plurality of nozzles on the circulation passage. The circulation passage may include a section which upwardly extends from the upper side to the lower side. In this case, the filter net is disposed to laterally traverse the upwardly extending section of the circulation passage, the nozzle disposition unit is disposed at a top side of the filter net, and the plurality of nozzles is provided at a bottom surface of the nozzle disposition unit and sprays the wash water in a downward direction.

The present invention presents a first embodiment to a third embodiment capable of realizing the relative motion. The nozzle disposition unit is fixed and the filter driving unit may move the filter unit to implement the relative motion. Further, the filter frame may include an edge frame configured to support the filter net along a peripheral of the edge frame. In this case, the filter driving unit may allow the edge frame to perform a rotation motion so that the relative motion may be implemented.

In order to easily remove foreign substances adhering to the filter net, the laundry handling apparatus may include a brush disposed to make contact with the filter net in a direction to traverse a motion track of the filter net. The brush may be disposed at a lower side with respect to the filter net.

Moreover, in order to remove foreign substances adhering to the bush, the nozzle disposition unit may be disposed at a lower side with respect to the filter net. In addition, the brush may be disposed to make contact with the filter net along a collision region of the wash water sprayed from the plurality of nozzles with the filter net.

In order to uniformly spray wash water to the entire area of the filter net, the present invention presents an arrangement and relationship of the plurality of nozzles. The nozzle disposition unit may protrude in a direction of a rotation axis of the rotation motion from a part of the periphery of the edge frame. In this case, the plurality of nozzles may include a first nozzle group configured by nozzles spaced apart from each other in one radial direction of the edge frame on the nozzle disposition unit.

Furthermore, the nozzles of the first nozzle group are spaced apart from each other by a predetermined distance d. In this case, a value obtained by dividing the predetermined distance d is defined by n as an equal value d/n, and distances between the nozzles of the first nozzle group and the rotation axis O are defined as reference values L, respectively. In this case, the plurality of nozzles comprises a n-th nozzle group configured by nozzles arranged at a position distant from the rotation axis O by a distance $L+(n-1)*d/n$ obtained by summing respective reference values L and (n−1) multiple of the equal value d/n, in different radial directions of the edge frame forming an angle a with one radial direction on the nozzle disposition unit.

In order to allow the filter driving unit to efficiently and durably operate, to prevent foreign substances from being easily collected in the filter driving unit, and to remove the foreign substances collected in the filter driving unit, the present invention presents structures and arrangement relationships of the filter net, the edge frame, the driven gear, the work gear (driven gear), and the motor. The edge frame may include a driven gear protruding in a direction of a rotation axis along a periphery of the edge frame. In this case, the filter driving unit includes: a worm gear meshing with the driven gear; and a motor configured to rotate the worm gear.

Moreover, the nozzle disposition unit may be disposed at a direction of a disposition surface of the driven gear of directions of both surfaces of the filter net. In this case, the nozzle disposition unit includes a nozzle configured to spray wash water to the driven gear.

Further, the driving gear and the worm gear may be disposed at a lower side with respect to the filter net.

In order to operate the present invention although foreign substances are inserted into the filter driving unit and to efficiently remove the foreign substances of the filter net, the present invention presents a function of the motor. A rotation direction of the motor 382 may be reversely changed if resistance greater than a predetermined reference occurs upon rotation of the motor. In addition, the filter driving unit and the driven gear may be provided so that the edge frame is rotated at speed in the range of 1 rpm to 6 rpm.

The details of other embodiments are contained in the detailed description and accompanying drawings.

Advantageous Effects

First, the present invention may uniformly clean the entire area of the filter net while easily separating the foreign substances collected in the filter net by directly spraying wash water to the filter net.

Second, since the number of nozzles may be reduced while uniformly washing the entire area of the filter net. Accordingly, the whole area of the filter net may be washed by strong shock of the wash water.

Third, since the number of nozzles may be reduced, although the nozzles are disposed right in front of the filter net, a part blocking the circulation passage is not large. Accordingly, the foreign substances collected in the filter net are easily separated by spraying the wash water in close proximity to the filter net so that pipeline resistance of the circulation passage is not almost increased.

Fourth, a cleaning performance of the nozzle may be increased by intensively spraying a constant amount of wash water and spraying the wash water to other areas with a time difference. In this way, the wash performance is significantly increased as compared with a case of simultaneously spraying the wash water to the entire area of the filter net.

Fifth, since the nozzle may be disposed right in front of the filter net, although there is a difference in water pressure or an error range of a product, a range of a preset part to spray wash water to the filter net does not significantly exceed a reference range. That is, the accuracy with respect to a spray range of the wash water is improved.

Sixth, foreign substances adhering to the filter net not to be easily separated by the wash water may be easily removed by using the brush.

Seventh, the sprayed wash water and the removed foreign substances may be easily drained through arrangement of the circulation passage, the filter unit, and the plurality of nozzles.

Eighth, the filter driving unit is efficiently and durably operated, and foreign substances are not easily collected in the filter driving unit. Even if foreign substances are collected in the filter driving unit, the collected foreign substances may be easily removed.

Ninth, when the filter driving unit receives resistance by the foreign substances inserted due to the relative motion, the present may have continuously a normal function by changing the relative motion in a reverse direction and the inserted foreign substances may be separated.

Effects of the present invention may not be limited to the above and other objects and other objects which are not described may be clearly comprehended to those of skill in the art to which the embodiment pertains through the following description.

MODE FOR INVENTION

Figure 1:
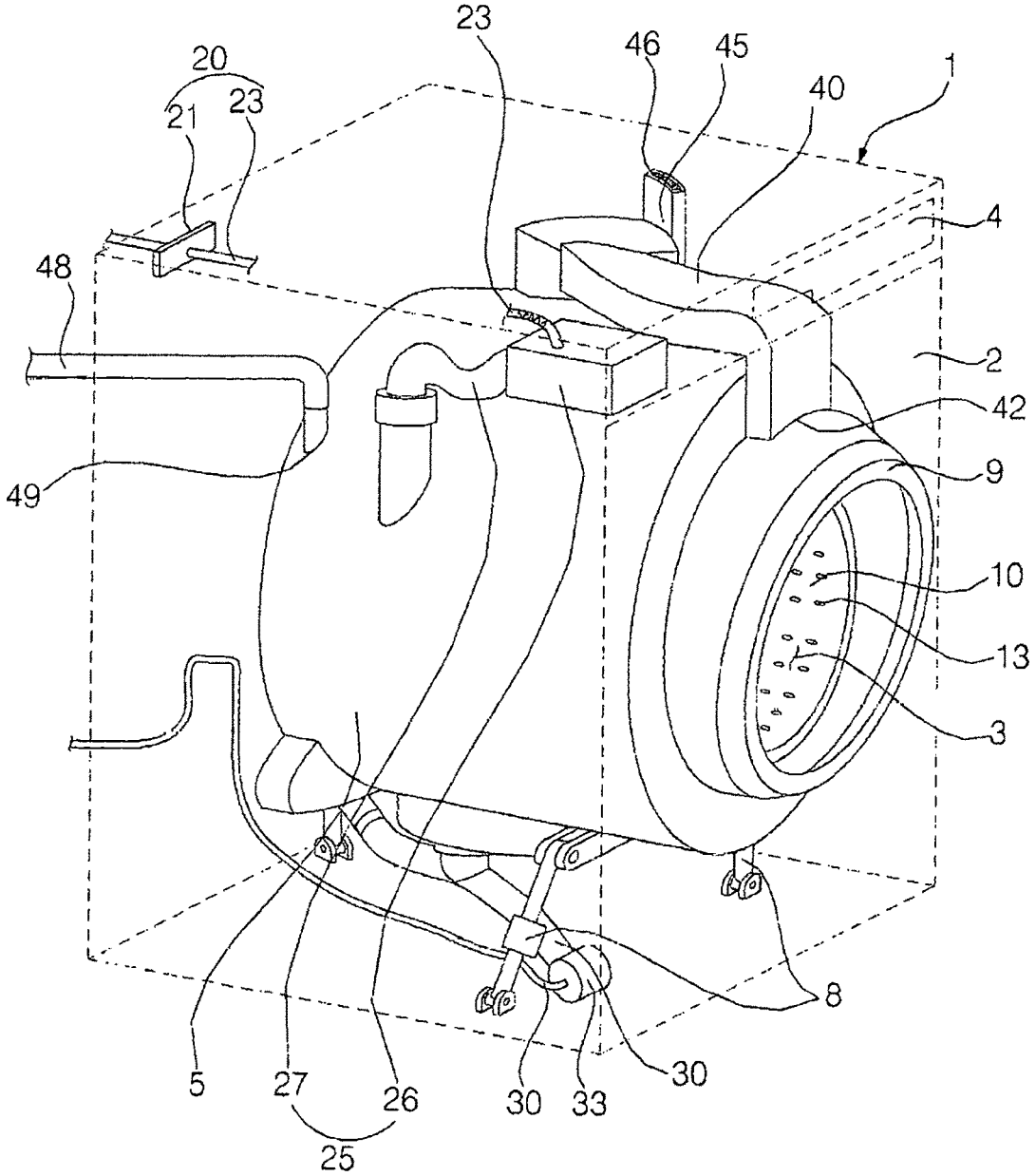
FIG. 1 is a perspective view illustrating an example of an internal configuration of a cabinet 1 in a laundry handling apparatus according to an embodiment of the present invention.

The advantages, the features, and schemes of achieving the advantages and features of the disclosure will be apparently comprehended by those skilled in the art based on the embodiments, which are described later in detail, together with accompanying drawings. However, the present invention is not limited to following disclosed embodiments and various embodiments may be realized. Present embodiments are provided to complete the disclosure of the present invention and to completely indicate the scope of the present invention to those of ordinary skill in the art. The present invention is defined by a scope of claims. The same reference numeral in the specification refers to the same constituent element.

A laundry treatment apparatus according to the present invention may be a washing machine, a dryer, and the like. Hereinafter, a laundry treatment apparatus according to the present invention is described to limit a front loading type washing machine with reference to FIG. 1 to FIG. 14 as an example. Although the washing machine may be a washing machine with a dry function including a circulation type dry system or a hybrid dry system, a washing machine including the hybrid dry system is restrictively described below.

Figure 2:
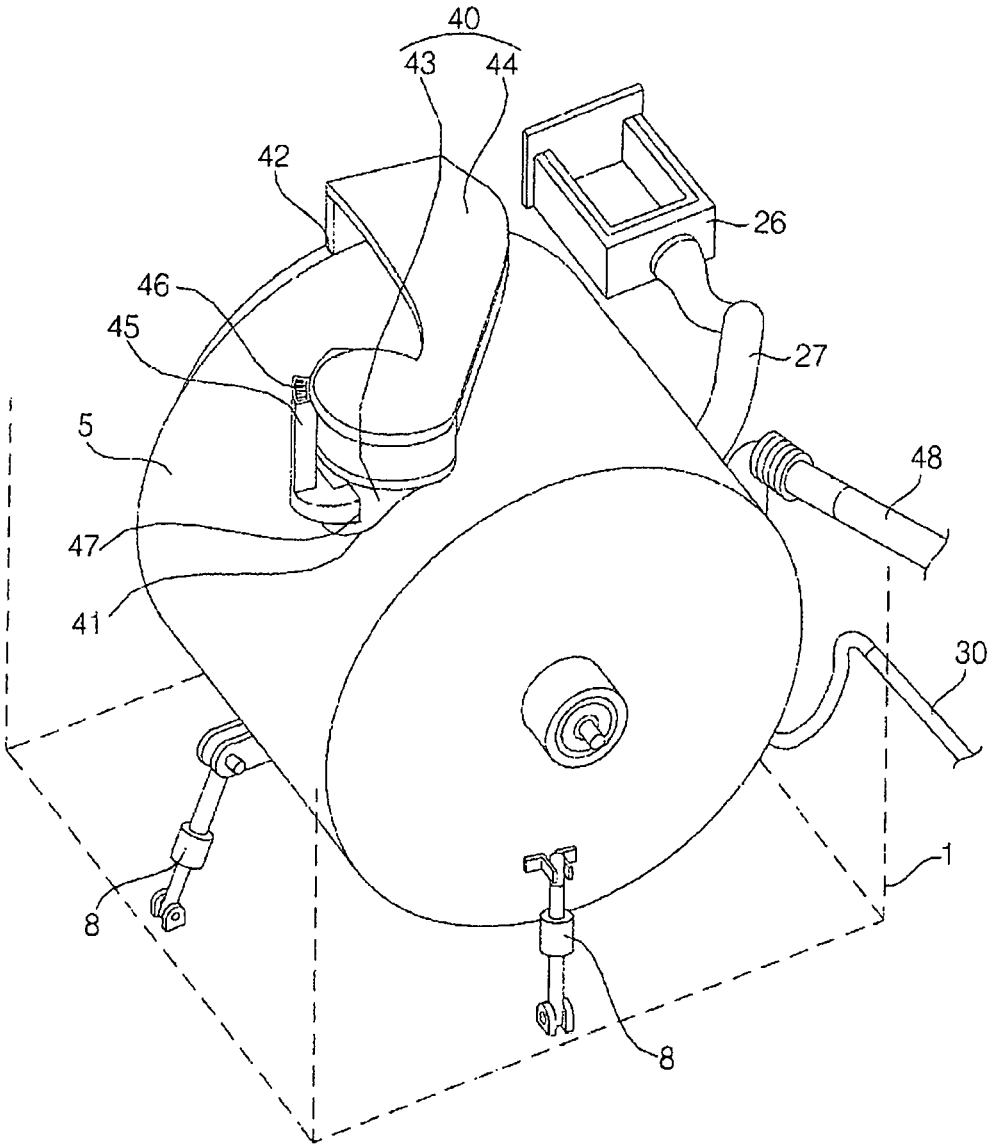
FIG. 2 is a perspective view illustrating the laundry treatment apparatus shown in FIG. 1 when the laundry handling apparatus is viewed at another angle.
Figure 3:
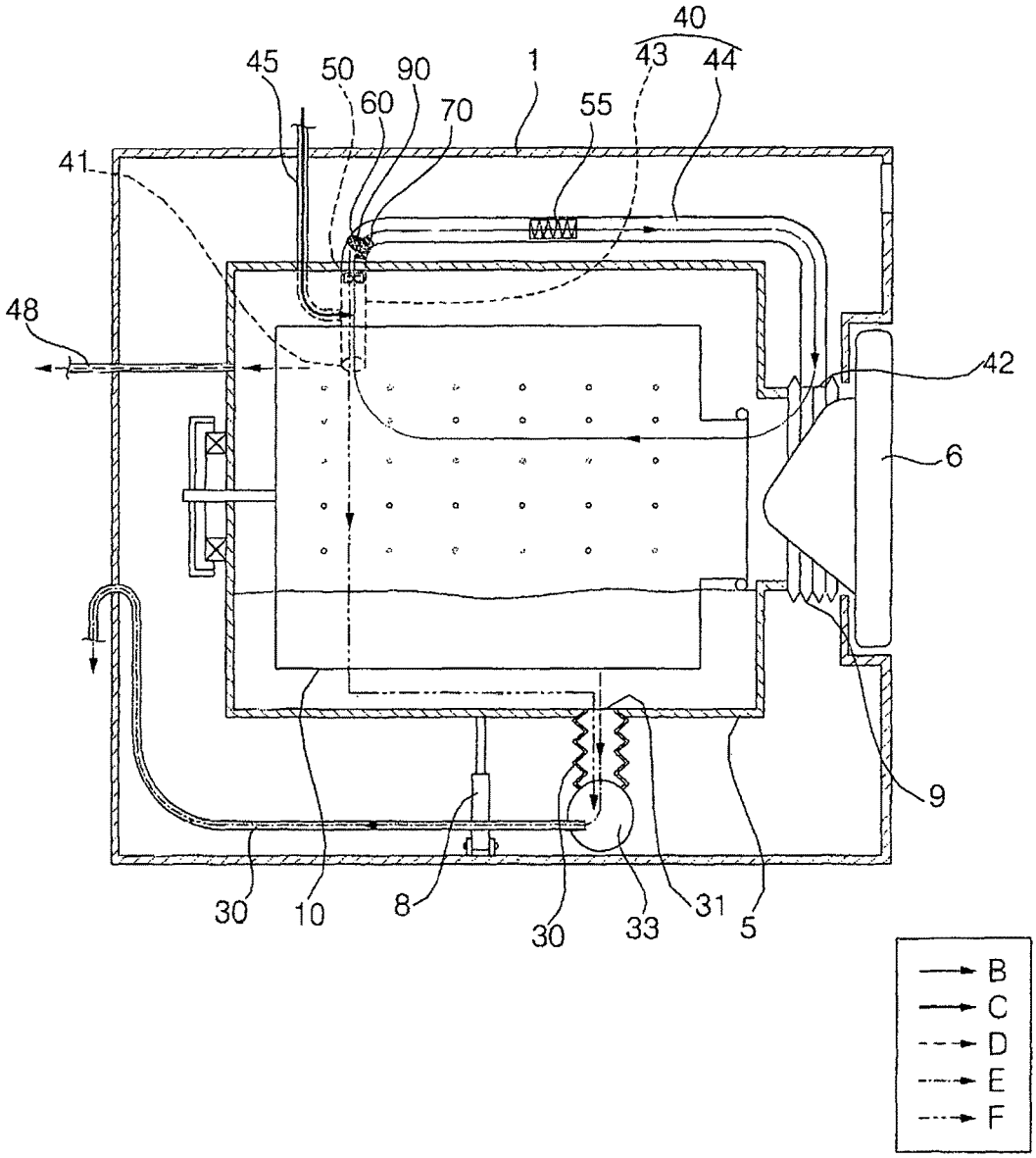
FIG. 3 is a conceptual section view illustrating a flow direction of air and water on a circulation passage 40, a suction passage 45, an exhaust passage 48, and a water drain passage 30 while vertically cutting the laundry handling apparatus in forward and reward directions.
Figure 4:
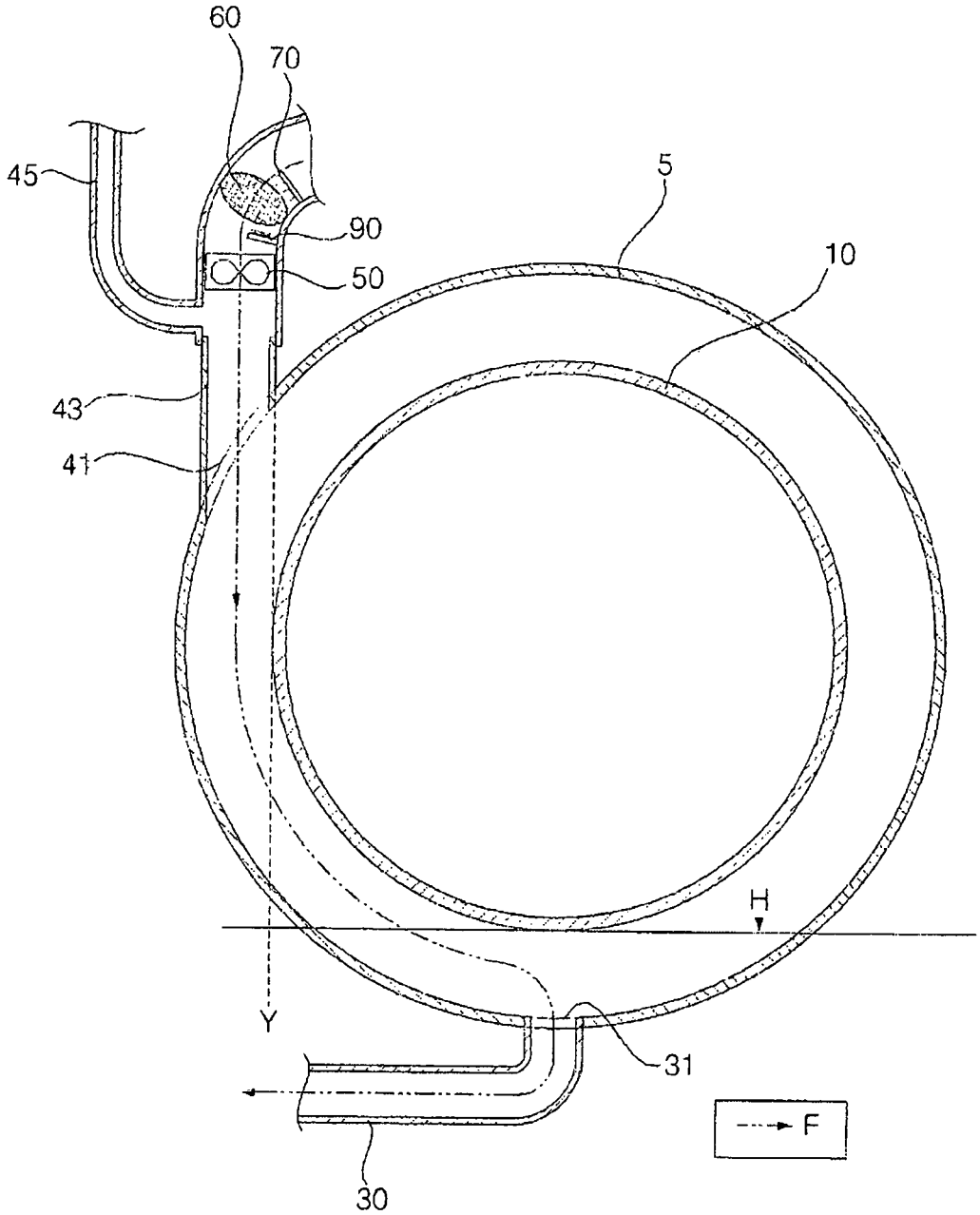
FIG. 4 is a conceptual section view illustrating a flow direction of air and water on a circulation passage 40, a suction passage 45, an exhaust passage 48, and a water drain passage 30 while vertically cutting the laundry handling apparatus in left and right directions.

FIG. 1 is a perspective view illustrating an example of an internal configuration of a cabinet 1 in a laundry treatment apparatus according to an embodiment of the present invention. FIG. 2 is a perspective view illustrating the laundry treatment apparatus shown in FIG. 1 when the laundry treatment apparatus is viewed at another angle. FIG. 3 is a conceptual section view illustrating a flow direction of air and water on a circulation passage 40, a suction passage 45, an exhaust passage 48, and a water drain passage 30 while vertically cutting the laundry treatment apparatus in forward and reward directions. FIG. 4 is a conceptual section view illustrating a flow direction of air and water on a circulation passage 40, a suction passage 45, an exhaust passage 48, and a water drain passage 30 while vertically cutting the laundry treatment apparatus in left and right directions.

The washing machine includes a cabinet 1 forming an outer appearance. The washing machine includes an outer tub 5 disposed inside the cabinet 1 to store wash water, and an inner tub 10 rotatably disposed inside the outer tub 5 and stores laundry.

Further, the washing machine includes a water supply part 20 configured to supply water from an external water source (not shown) into the outer tub and a detergent supply part 25 configured to supply detergent to the outer tub 5. Moreover, the washing machine further includes a water drain passage 30 which is connected to the lower surface of the outer tub 5 so as to guide water inside the outer tub 5 to be drained to the outside. The washing machine include a water drain pump 33 provided on the water drain passage 40 to drain water.

Further, the washing machine includes a circulation passage 40 to guide at least some of air inside the outer tub 5 to flow out of the outer tub 5 and be resupplied to the outer tub 5. The washing machine includes a fan 50 provided on the circulation passage 40 to move air on the circulation passage 40. Furthermore, the washing machine includes a temperature and humidity controller (not shown) such as heater 550 or a cooler (not shown) configured to reduce humidity of air on the circulation passage 40 or to increase a temperature of the air.

Moreover, the washing machine includes a suction passage 45 to guide external air of the outer tub 5 or the cabinet 1 to be introduced into the outer tub 5. The washing machine includes an exhaust passage 48 to guide remaining air of air inside the outer tub 5 except for partial air introduced into the circulation passage 40 to be exhausted.

In addition, the washing machine includes a filer unit 60 provided on the circulation passage 40 to filter foreign substances included in air. The filer unit 60 includes filter nets 161, 261, and 361 disposed on the circulation passage 40 to collect foreign substances included moving air, and filter frames 163, 263, and 363 configured to support the filter nets 161, 261, and 361.

Moreover, the washing machine a plurality of nozzles 175, 275, and 375 configured to spray cleaning water to partial areas of the filter nets 161, 261, and 361. The washing machine includes a nozzle disposition part 70 spaced apart from the filter nets 161, 261, and 361 and in which a plurality of nozzles 175, 275, and 375 are arranged. The washing machine includes nozzle water supply hoses 172, 272, and 372 connected to the nozzle disposition part 70 to supply cleaning water sprayed from the plurality of nozzles 175, 275, and 375.

Further, the washing machine includes a filter driving unit to control the filer unit 60 and the nozzle disposition part 70 to move relative to one another. Although the plurality of nozzles 175, 275, and 375 spray the cleaning water to partial areas of the filter nets 161, 216, and 361, the cleaning water is sprayed to the total area of the filter nets 161, 216, and 361 with a time difference due to the relative motion.

Further, the washing machine may include a brush 90 configured to remove foreign substances collected in the filer unit 60. The brush 90 sweeps surface of the filter nets 161, 216, and 361 to drop foreign substances collected in the filter nets 161, 216, and 361. At least some of the foreign substances dropped from the filter nets 161, 216, and 361 by the brush 90 adhere to the brush 90.

The cabinet 1 includes a front panel 2 to form a front surface of the washing machine. The front panel 2 is formed therein with an input port 3 to input or output laundry into or from the inner tub 10. A door 60 opens/closes the input port 3 and is hinged to the front panel 2 to open/close the input port 3. Further, the cabinet 1 includes two side panels (not shown) forming left and right surfaces, a top panel (not shown) forming a top surface, a bottom panel (not shown) forming a bottom surface, and a rear panel (not shown) forming a rear surface.

The front panel 2 includes a control panel 4 being a user interface. The control panel 4 is means to allow a user to exchange information with a controller (not shown) of the washing machine.

The control panel 4 includes a power input unit (not shown) configured to allow a user to input a power supply command to the washing machine and an input unit (not shown) configured to allow the user to select a realizable laundry treatment method of a device. The laundry treatment method includes a method for controlling water or air to be supplied into the laundry. The control panel 4 may include a display unit (not shown) configured to display information on a laundry treatment method or an operation process of a washing machine selected by a user.

The outer tub 5 has a cylindrical shape and is fixed inside the cabinet 1 by an outer tub support part 8. An outer input port (not shown) communicating with the input port 3 is provided at a front surface of the outer tub 5.

A gasket 9 is provided between the outer tub input port and the input port 3. The gasket 9 prevents vibration occurring from the outer tub 5 from being transferred to the cabinet 1 and prevents the cleaning water stored inside the outer tub 5 from being leaked. The gasket 9 may be made of an elastic material such as rubber.

The inner tub 10 is rotatably disposed inside the outer tub 5 by a driving unit (not shown) provided at a rear surface of the outer tub 5. The inner tub 10 is formed therein with an inner tub input port (not shown) communicating with the outer tub input port. The inner tub 10 is formed therein with a plurality of through holes 13 formed through an outer peripheral surface arrange along the outer peripheral surface.

The water supply part 20 includes a water supply passage 23 configured to guide water from an external water source (not shown) to a detergent supply part 25 and a water supply valve 21 configured to open/close the water supply passage 23. The detergent supply part 25 includes a detergent storing part 26 configured to store a detergent and an outer tub supply pipe 27 configured to guide water containing the detergent from the detergent storing part 26 into the outer tub 5. The detergent storing part 26 may be provided to be detached from the front panel 2. Hereinafter, the water supplied into the outer tub 5 through the outer tub supply pipe 27 is defined as wash water.

The water supply part 20 includes nozzle water supply hoses 172, 272, and 372 configured to guide water to the nozzle disposition part 70. In this case, the water supply part 20 may include a nozzle water supply valve (not shown) configured to open/close the nozzle water supply hoses 172, 272, and 372. Each end of the nozzle water supply hoses 172, 272, and 372 may be directly connected to the water supply source and may be branched from the water supply passage 23 to be connected to the water supply source. Another end of the nozzle water supply hoses 172, 272, and 372 are connected to a water supply connecting part 73 (see FIG. 3) which is formed at one side of the nozzle disposition part 70. Hereinafter, water sprayed to the nozzle 175, 275, and 375 through the nozzle water supply hoses 172, 272, and 372 is defined as cleaning water.

A start end of the water drain passage 30 is connected with a lower side of the outer tub 5. A water drain hole 31 communicating an inside of the outer tub 5 with the water drain passage 30 at a point connected with the water drain at the lower side of the outer tub 5.

It is preferred that the drain pump 33 is disposed at a side lower than a level of the clearing water inside the outer tub 5 and is disposed at the lowermost point on the water drain passage 30. The water drain passage 30 extends from the water supply hole 31 to a water flow introduction port (not shown) of the drain pump 33, and extends a water flow outflow port (not shown) of the drain pump 33 to an outside of the cabinet 1.

The water drain passage 30 includes a section upwardly extending to a position higher than a level of wash water inside the outer tub 5. Accordingly, a water trap is formed due to water drained from the water drain passage 30.

The circulation passage 40 guides some of air inside the outer tub 5 to flow out of the outer tub 5 and to be resupplied to the outer tub 5. The circulation passage 40 may be provided at a lower circumferential surface of the outer tub 5. A start end 41 and a termination end 42 of the circulation passage 40 are connected to the outer tub 5.

The start end of the circulation passage 40 is connected to a side surface of the outer tub 5. A "the start end 41 of the circulation passage 40 is connected to a side surface of the outer tub 5" means to include "the start end is connected between a side surface and a top surface of the outer tub 5".

The termination end 42 of the circulation passage 40 is connected to a top side of the gasket 9. That is, a hole is formed through the gasket 9 and the circulation passage 40 is connected to the hole.

A direction from the start end 41 to the termination end 42 on the circulation passage 40 is a flow direction of air inside the circulation passage 40. An upper side and a lower side are defined based on the flow direction of air. The circulation passage 40 includes a section 43 which upwardly extends from the upper side to the lower side. The circulation passage 40 may be provided so that a start end of the upwardly extending section 43 becomes a start end of the circulation passage 40. The circulation passage 40 includes a section 44 which is bent from a termination end of the upwardly extending section 43 in a direction of the gasket 9 and extends in a forward direction.

The fan 40 is provided in the upwardly extending section 43 on the circulation passage 40. The heater 55 or the cooler (not shown) is provided at a forward extending section 44.

The suction passage 45 may be directly connected to the outer tub 5, and may be connected on the circulation passage 40 as in the present embodiment. In the present embodiment, the suction passage 45 guides external air to be introduced into the circulation passage 40. The heater 55 is provided at the lower side of an suction passage connection end 47 on the circulation passage 40 being a point in which air inside the suction passage 45 is introduced into the circulation passage 40. Further, the fan 50 is provided at the lower side of a suction passage connection end 47 on the circulation passage 40. Accordingly, both of air circulated to one heater 43 and sucked air may be heated, and air may be circulated to one a circulation fan 41 and air may be sucked.

An suction port 46 of the suction passage 45 is an opening portion in which external air is introduced in the suction passage 45. When the suction port 46 is formed inside the cabinet 1, air present at a space between the cabinet 1 and the outer tub 5 is introduced into the suction passage 45. When the suction port of the suction passage 45 is formed outside the cabinet 1, external air of the cabinet 1 is introduced into the suction passage 45. In the specification, the term 'external air' means include both of the external air of the cabinet 1 and air between the cabinet 1 and the outer tub 5.

The filer unit 60 is provided a lower side of the suction passage connection end 47 on the circulation passage 40. The filer unit 60 is provided inside the upwardly extending section 43, which means to include a case where the filer unit 60 is provided at a termination end of the upwardly extending section 43 being a point between the upwardly extending section 43 and the forward extending section 44. The filer unit 60 is provided at a lower side of the fan 50 on the circulation passage 40. The filer unit 60 is provided at an upper side of the heater 55 or the cooler on the circulation passage 40.

The filter nets 161, 261, and 361 are disposed to traverse a section of the circulation passage 40. The filter nets 161, 261, and 361 are disposed to traverse the upwardly extending section 43, which means to include a case where the filter nets 161, 261, and 361 are disposed to traverse a termination end of the upwardly extending section 43 being a point between the upwardly extending section 43 and the forward extending section 44. The filter nets 161, 261, and 361 are laterally disposed to traverse the upwardly extending section 43. The term 'laterally' means to include a case where the filter nets 161, 261, and 361 are inclined toward a horizontal direction.

The nozzle disposition part 70 is disposed at a lower side with respect to the filter nets 161, 261, and 361 on the circulation passage 40. The nozzle disposition part 70 is disposed close to the filter nets 161, 261, and 361. In an embodiment where the filter nets 161, 261, and 361 are laterally disposed to traverse the upwardly extending section 43, the nozzle disposition part 70 is disposed at top sides of the filter nets 161, 261, and 361.

The nozzle disposition part 70 is formed therein with a nozzle water supply passage through which cleaning water passes. A water supply connecting part is formed at a side of the nozzle disposition part 70, and cleaning water is introduced into the nozzle water supply passage through the water supply connection part.

The plurality of nozzles 175, 275, and 375 communicating with the nozzle water supply passage are formed at a surface viewing the filter nets 161, 261, and 361 of the nozzle disposition part 70. The plurality of nozzles 175, 275, and 375 spray cleaning water in a direction in which the filter nets 161, 261, and 361 are disposed. In an embodiment where the nozzle disposition part 70 is disposed at top sides of the filter nets 161, 261, and 361, the plurality of nozzles 175, 275, and 375 are provided at a bottom surface of the nozzle disposition part 70 and spray the cleaning water in a downward direction. The plurality of nozzles 175, 275, and 375 are disposed in a direction to traverse a track of the relative motion on a bottom surface of the nozzle disposition part 70.

The brush 90 makes contact with the filter nets 161, 261, and 361 in a direction to traverse the track of the relative motion. The brush 90 is disposed at a lower side with the filter net on the circulation passage 40. In an embodiment where the filter nets 161, 261, and 361 are disposed to laterally traverse the upwardly extending section 43, the brush 90 is disposed at lower sides of the filter nets 161, 261, and 361. The brush 90 is disposed in a direction where the plurality of nozzles 175, 275, and 375 are arranged. That is, the brush 90 makes contact with the filter nets 161, 261, and 361 along a collision part of cleaning water sprayed from the plurality of nozzles 175, 275, and 375 with the filter nets 161, 261, and 361.

Further, the washing machine includes a brush arm 92 configured to support the brush 90. The brush 90 is fixed to a brush fixing part 91 along the brush arm 92.

Further, the washing machine may include a water level sensor (not shown) configured to detect a water level inside the outer tub 5. Referring to FIG. 4, the water level sensor may transmit a signal at a maximum level H when laundry inside the inner tub 10 is not sunk under wash water. That is, the water level sensor may transmit a signal at a maximum level H when a level inside the outer tub 5 is less than a lowermost part of the inner tub 10.

The washing machine may include a controller (not shown) configured to receive a signal transmitted from the water level sensor. When the controller receives the signal, the controller operates a filter driving unit to control cleaning water to be sprayed to the plurality of nozzles 175, 275, and 375 while performing the relative motion.

A flow of air and water according the present embodiment will be described with reference to FIG. 3 and FIG. 4 as follows.

A B arrow direction is an air circulation direction of an outer tub 5. When a fan 50 is operated, some of air from an inside of the outer tub 5 in a positive pressure state is moved to a circulation passage 40 in a negative pressure state through a start end 41 of the circulation passage 40. The air moved to the circulation passage 40 is mixed with external air at the exhaust passage connecting end 47 point. The mixed air is moved to a termination end 42 of the circulation passage 40 sequentially through the fan 50, the filer unit 60, and the heater 43. The air moved to the termination end 42 of the circulation passage is resupplied into the outer tub 5.

A C arrow direction is a suction direction of external air. When a circulation fan 41 is operated, external air from an outside of the outer tub 5 or an outside of the cabinet 1 in an atmospheric pressure state is introduced into a circulation passage 40 in a negative pressure state. The air introduced into the circulation passage 40 is supplied into the outer tub 5 sequentially through the fan 50, the filer unit 60, and the heater 43.

A D arrow direction is an exhaust direction of air. When the fan 50 is operated, the air is exhausted from an inside of the outer tub 5 in a positive pressure state to an outside of the outer tub 5 or the cabinet 1 along an exhaust passage 48.

An E arrow direction is a water drain direction of water (the wash water and the cleaning water). Water inside the outer tub 5 is introduced into a drain passage 33 through a water drain hole 31. When the drain pump 33 is operated, water introduced into the water drain passage 33 from the outer tub 5 is drained to an outside of the cabinet 1.

An F arrow direction is a flow direction of cleaning water sprayed from nozzles 175, 275, and 375. The cleaning water sprayed from the nozzles 175, 275, and 375 passes through the filer unit 60. At least some of the cleaning water passing through the filer unit 60 collides with the brush 90. Next, the cleaning water is moved to the start end 41 of the circulation passage along the upwardly extending section due to gravity. The cleaning water moved to the start end 41 of the circulation passage is introduced into the outer tub 5. The cleaning water introduced into the outer tub 5 is moved downward along an inner surface of the outer tub due to gravity or falls to a lower side of the outer tub 5 due to the gravity. An opening portion formed at the start end 41 of the circulation passage is formed outward of a virtual vertical line Y making contact with an outer peripheral surface of the inner tub 10 so that cleaning water introduced and fallen inside the outer tub 5 is not introduced into the inner tub 10 through an inner tub through hole 13. The cleaning water moved to a lower side of the outer tub 5 is introduced into the water drain passage 33 through a water drain hole 31. When the drain pump 33 is operated, the cleaning water introduced into the water drain passage 33 from the outer tub 5 is drained to an outside of the cabinet 1 together with wash water. In this case, if the cleaning water is drained at a time less than the level H, cleaning water including foreign substances of filter nets 161, 261, and 361 is drained not to be introduced into the inner tub 10 so that laundry inside the inner tub 10 is not polluted due the foreign substances.

The washing machine includes a filter driving unit for controlling the filer unit and the nozzle disposition part to move relative to one another so that the cleaning water is sprayed to the entire area of the filter net. Although the plurality of nozzles 175, 275, and 375 spray cleaning water to only partial areas of the filter nets 161, 261, and 361 at a certain time point, the filter driving unit controls the filer unit 60 and the nozzle disposition part 70 to move relative to one another to sequentially spray the cleaning water to the total area of the filter nets 161, 261, and 361. Hereinafter, a first embodiment to a third embodiment of the relative motion will be described with reference to FIG. 5 to FIG. 10.

Figure 5:
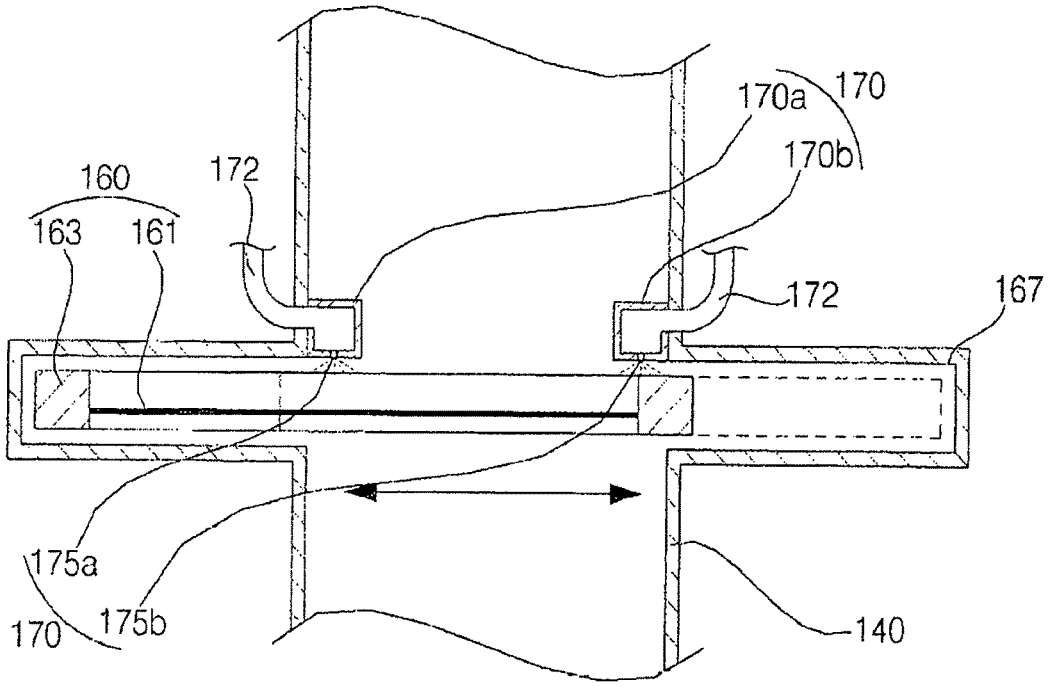
FIG. 5 is a conceptual section view illustrating a first embodiment of a relative motion where a nozzle disposition part 170 is fixed and a filer unit 160 performs a linear reciprocating motion.

Referring to FIG. 5, a first embodiment is a relative motion embodiment where a nozzle disposition part 170 is fixed and a filer unit 160 performs a linear reciprocating motion. A filter frame 163 supports the filter net 161 and laterally performs a linear reciprocating motion in a section of the upwardly extending section 43 of the circulation passage 140. The filter net 161 is fixed to the filter frame 163 and laterally performs a linear reciprocating motion in a section of the circulating passage 140 along the linear reciprocating motion of the filter frame 163.

In order to cover the whole section of the circulation passage 140 by the filter net 161 at all-time points while the linear reciprocating motion is performed, a filter net 161 is provided so that the lateral area of the filter net 161 becomes minimum twice of a sectional area of the circulation passage 140.

A filter frame guide 167 for guiding a lateral linear reciprocating motion of the filter frame 163 is formed at an inner surface of the circulation passage 140. The filter frame guides 167 are provided at one side and an opposite side of the circulation passage 140 in a direction of the linear reciprocating motion at a point in which the filter frame is arranged, respectively. A depression region where a filter frame 163 is retracted and extended according to the linear reciprocating motion is formed at an inner surface of the circulation passage 140. The filter frame guide 167 is fixed to the depression region to guide the linear reciprocating motion while supporting the filter frame 163. The filter frame guide 167 includes a rail (not shown) and the filter frame 163 slides the rail to perform the linear reciprocating motion.

The nozzle disposition part 170 is disposed at a lower side of the filter net 161 on the upwardly extending section 43. That is, the nozzle disposition part 170 is disposed at a top side of the filter net 161 on the upwardly extending section 43. The nozzle disposition part 170 extends to a direction parallel to a surface of the filter net 161 among directions vertical to the linear reciprocating motion direction of the filter net 161.

The plurality of nozzles 175 are arranged in an extending direction of the nozzle disposition part 170 on a bottom surface of the nozzle disposition part 170. That is, the plurality of nozzles 175 are arranged in a direction to traverse the linear reciprocating motion track of the filter net 161.

It is preferred that minimum two nozzle disposition parts 170 are disposed at both sides in order to spray cleaning water to all areas of the filter net 161 in 1 cycle of the linear reciprocating motion of the filter net 161. A first nozzle disposition part **170*a* is provided at one side of a section of the circulation passage 140, and a second nozzle disposition part 170*b* is provided at another side of a section of the circulation passage 140. The plurality of nozzles 175 includes one nozzle group 175*a* arranged along the first nozzle disposition part 170*a* on a bottom surface of the first nozzle disposition part 170*a* and another nozzle group 175*b* arranged along the second nozzle disposition part 170*b* on a bottom surface of the second nozzle disposition part 170*b***.

A filter driving unit (not shown) of a first embodiment includes a motor (not shown), a crank shaft (not shown) rotated by the motor, and a connecting rod (not shown) to connect the crank shaft with the filter frame 163. A rotational motion of the motor is converted into the linear reciprocating motion of the filter frame 163.

Figure 6:
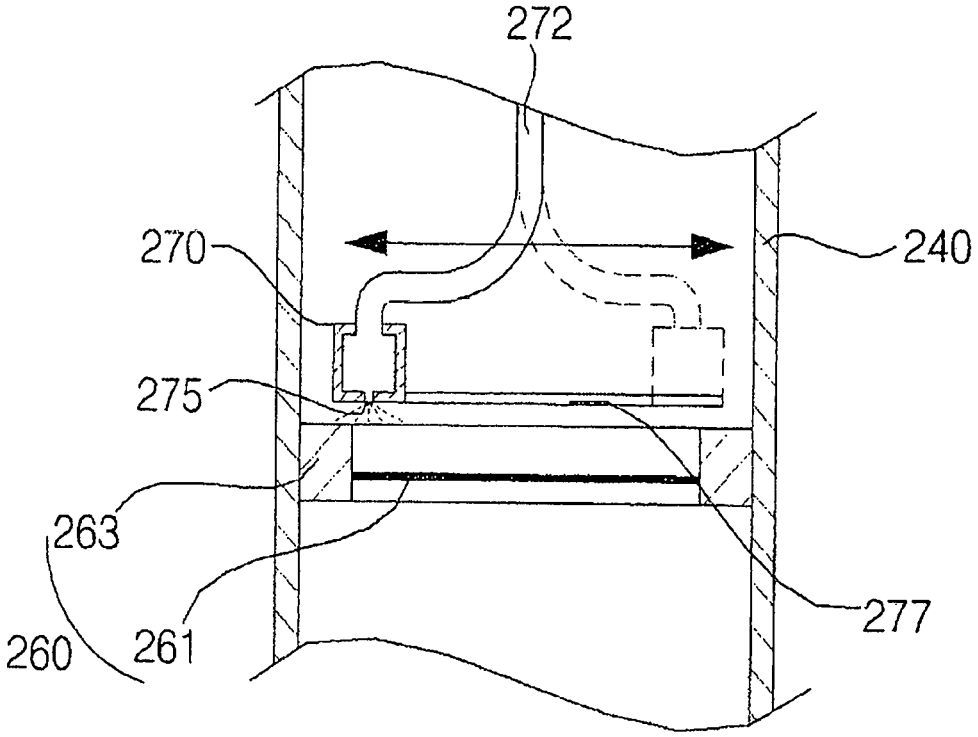
FIG. 6 is a conceptual section view illustrating a second embodiment of a relative motion whew a filer unit 160 is fixed and a nozzle disposition part 270 performs a linear reciprocating motion.
Figure 7:
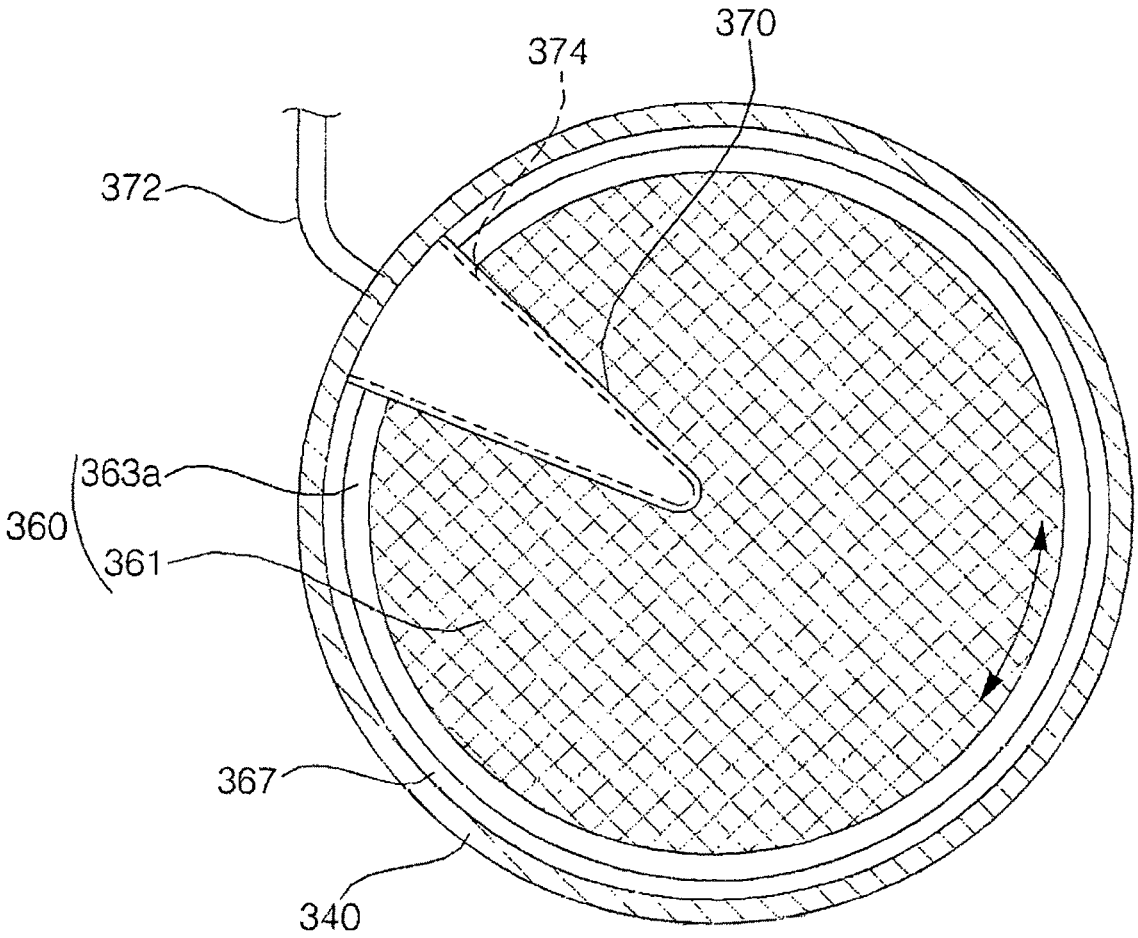
FIG. 7 is a conceptual section view illustrating a third embodiment of a relative motion where a nozzle disposition part 370 is fixed and a filer unit 360 performs a rotational motion.

Referring to FIG. 6, a second embodiment is a relative motion embodiment where the filer unit 260 is fixed and the nozzle disposition part 270 performs the linear reciprocating motion. The filter frame 263 supports the filter net 261 supports the filter net 261 and the filter net 261 is fixed to laterally traverse on a section of the upwardly extending section 43 of the circulation passage 240. The nozzle disposition part 270 laterally performs the linear reciprocating motion on a section of the circulation passage 140. That is, the nozzle disposition part 270 performs the linear reciprocating motion on a virtual surface parallel to a surface of the filter net 261.

The nozzle disposition part 270 is disposed at a lower side of the filter net 261 on the upwardly extending section 43. That is, the nozzle disposition part 270 is disposed at a top side of the filter net 261 on the upwardly extending section 43. The nozzle disposition part 270 extends in a direction parallel to a surface of the filter net 261 among directions vertical to the linear reciprocating motion direction of the nozzle disposition part 270.

The plurality of nozzles 275 are arranged in an extending direction of the nozzle disposition part 270 on a bottom surface of the nozzle disposition part 270. The plurality of nozzles 275 is arranged in a direction to traverse the linear reciprocating motion track of the nozzle disposition part 270.

The circulation passage 240 is formed therein with a nozzle disposition part guide (not shown) to guide a lateral reciprocating motion of the nozzle disposition part 270. The nozzle disposition part guides are disposed at one end and another end of the nozzle disposition part 270 in the linear reciprocating motion direction of the nozzle disposition part 270, respectively. A rail (not shown) laterally extending along the reciprocating motion track of the nozzle disposition part 270 is provided at an inner surface of the circulation passage 140. One end and another end of the nozzle disposition part 270 slide the rail to perform the linear reciprocating motion.

The nozzle water supply hose 272 of the second embodiment is a flexible material. The nozzle water supply hose 272 is connected to a water supply connecting part (not shown) of the nozzle disposition part 270. The nozzle water supply hose 272 is connected to the nozzle disposition part 270 to repeat a motion which is bent and spread according to the linear reciprocating motion of the nozzle disposition part 270.

A filter driving unit (not shown) of the second embodiment includes a motor (not shown), a crank shaft (not shown) rotated by the motor, and a connecting rod (not shown) to connect the crank shaft with the nozzle disposition part 270. A rotational motion of the motor is converted into the linear reciprocating motion of the nozzle disposition part 270.

Figure 8:
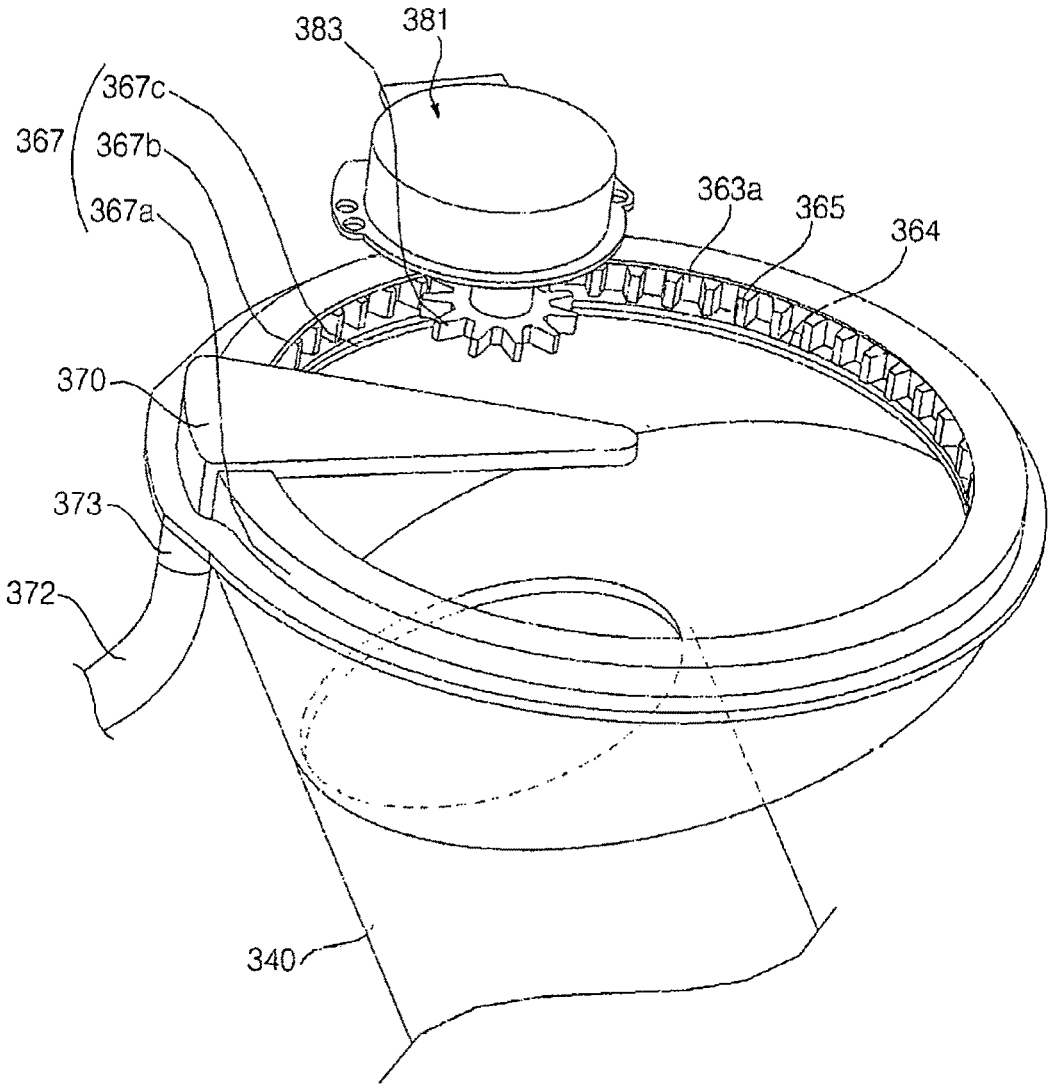
FIG. 8 is a perspective view illustrating a filer unit 360 omitting a filter net, a nozzle disposition part 370, and a filter driving unit 380 according to the third embodiment.
Figure 9:
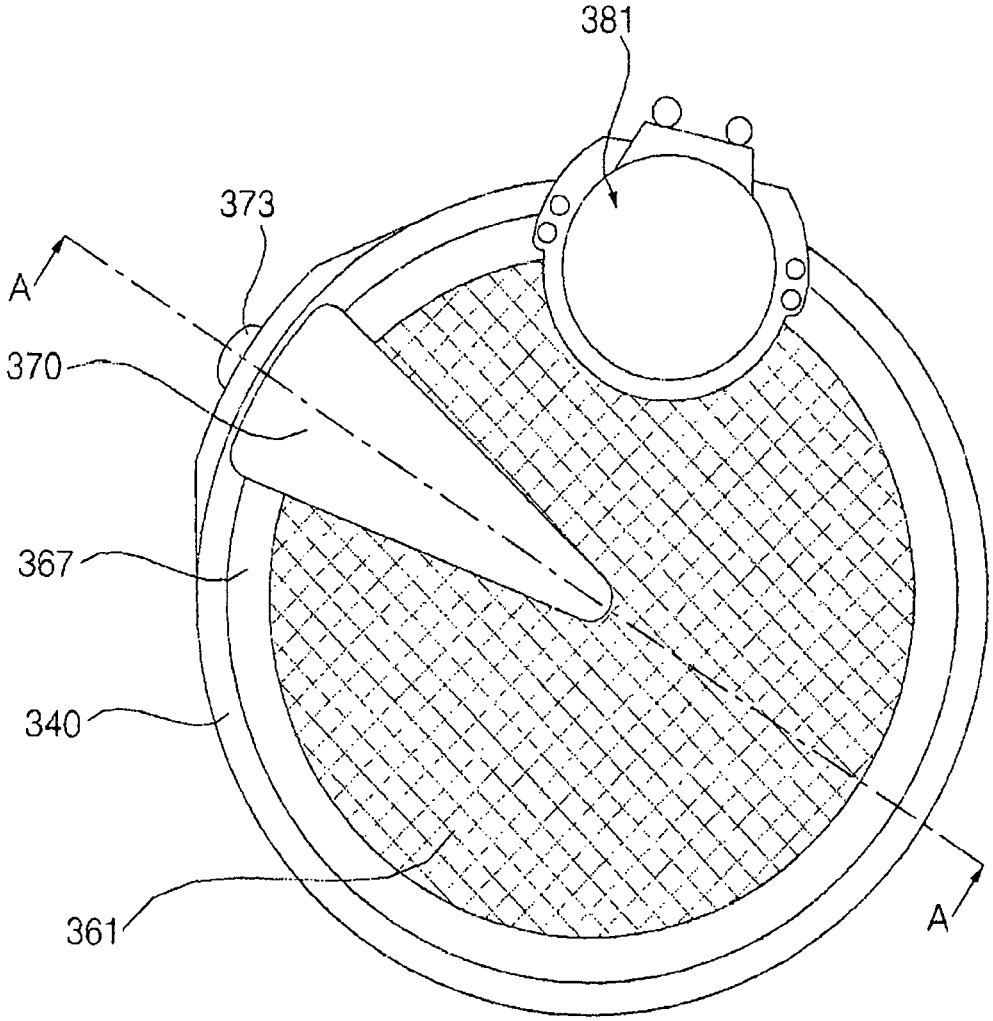
FIG. 9 is an elevation view illustrating the filer unit 360, the nozzle disposition part 370, and the filter driving unit 380 according to the third embodiment when viewed from the top.
Figure 10:
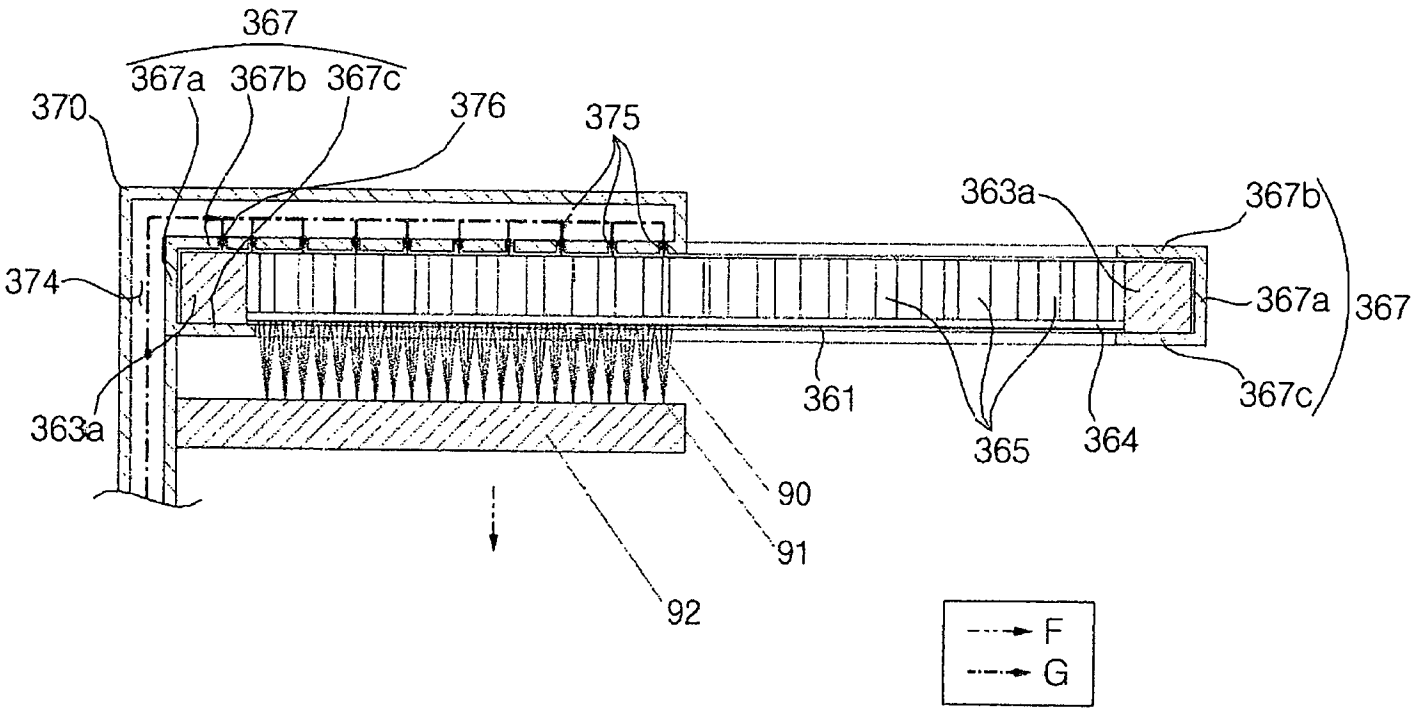
FIG. 10 is a sectional view illustrating the filer unit 360 and the nozzle disposition part 370 taken along line A-A' of FIG. 9 by vertically cutting the filer unit 360 and the nozzle disposition part 370.

Referring to FIG. 7 to FIG. 10, a third embodiment is a relative motion embodiment where the nozzle disposition part 370 is fixed and the filer unit 360 performs the linear reciprocating motion. FIG. 8 is a perspective view illustrating a filer unit 360 omitting a filter net, a nozzle disposition part 370, and a filter driving unit 380 according to the third embodiment. FIG. 9 is an elevation view illustrating the filer unit 360, the nozzle disposition part 370, and the filter driving unit 380 according to the third embodiment when viewed from the top. FIG. 10 is a sectional view illustrating the filer unit 360 and the nozzle disposition part 370 taken along line A-A' of FIG. 9 by vertically cutting the filer unit 360 and the nozzle disposition part 370.

The third embodiment may include a filter net 340 having an area smaller than an area of the filter net 161 according to the first embodiment. There is no need to protrude a filter frame guide 367 to a lateral direction of the circulation passage 340 unlike the filter frame guide 167 according to the first embodiment. Although the first embodiment needs minimum two nozzle disposition parts 170, the third embodiment is sufficient to include one nozzle disposition part 370. Further, unlike the nozzle water supply hose 272 of the second embodiment, the nozzle water supply hose 372 does not need to repeat a bending and spread motion.

The filter frame 363*a* of the third embodiment includes a ring shaped edge frame 363*a* which extends around a section of the circulation passage 340. The edge frame 363*a* supports the filter net 363 along the circumference. The edge frame 363*a* may have a ring shape. The edge frame 363*a* supports the filter net 363 and performs a rotational motion on a section of the upwardly extending section of the circulation passage 340. The filter net 361 is fixed to the edge frame 363*a* and performs a rotational motion on a surface of the filter net 363 according to the rotational motion of the edge frame 363*a*.

A filter frame guide 367 is formed on an inner surface of the circulation passage 340 and guides a rotational motion of the edge frame 363*a* around the edge frame 363*a*. The filter frame guide 367 is formed to have a ring shape around a section of the circulation passage 340. The filter frame 367 is fixed on an inner surface of the circulation passage 340 and guides the rotational motion while supporting the edge frame 363*a*. The filter frame guide 367 includes a rail (not shown), and the edge frame 363*a* slides the rail to perform the rotational motion.

The filter frame guide 367 includes a lateral guide 367*a* to have a ring shape to make contact with an outer peripheral surface of the edge frame 363*a*. The filter frame guide 363 includes a first rib 367*b* which protrudes in a direction of a rotation axis of the rotational motion from an upper portion of the lateral guide 367*a* and extends around the lateral guide 367*a*. A bottom surface of the first rib 367*b* makes contact with a top surface of the edge frame 363*a* to guide rotation of the edge frame 363*a*. The filter frame guide 367 includes a second rib 367*c* which protrudes in a direction of a rotation axis of the rotational motion from a lower portion of the lateral guide 367*a* and extends around the lateral guide 367*a*. A top surface of the second rib 367*c* makes contact with a bottom surface of the edge frame 363*a* to guide rotation of the edge frame 363*a*.

The nozzle disposition part 370 is disposed at a lower side of the filter net 361 on the upwardly extending section 43. That is, the nozzle disposition part 370 is disposed at a top side of the filter net 361 on the upwardly extending section 43. The nozzle disposition part 370 extends to a direction parallel to a surface of the filter net 361 among radial directions of the rotation motion track of the filter net 361. The nozzle disposition part 370 protrudes to a direction of a rotation axis of the rotation motion from a part of a periphery of the edge frame 363*a*. That is, the nozzle disposition part 370 extends to one radial direction of the edge frame 363*a*.

The nozzle disposition part 370 is formed therein with a nozzle water supply passage 374 through which cleaning water passes. That is, the nozzle disposition part 370 has a structure to surround a nozzle water supply passage 374 being an internal space by an external case. The nozzle disposition part 370 includes a top surface, a bottom surface, and both side surfaces of the nozzle water supply passage 374 extending to a radial direction of the edge frame 363*a*.

The bottom surface of the nozzle disposition part 370 is disposed on the same plane as the first rib 367*b* and the filter guide 367 and the nozzle disposition part 370 are integrally injection-molded. A water supply connecting part 373 connected with the nozzle water supply hose 372 is formed at a radial outer side of the nozzle disposition part 370. The cleaning water is introduced into the nozzle water supply passage 374 through the water supply connecting part 373.

A plurality of nozzles 375 communicating with the nozzle water supply passage 374 is formed on a bottom surface of the nozzle disposition part 370. The plurality of nozzles 375 are arranged in an extending direction of the nozzle disposition part 370. The plurality of nozzles 375 is arranged in a direction to traverse the rotation motion track. The plurality of nozzles 375 sprays cleaning water in a downward direction in which the filter net 361 is arranged.

In order to spray cleaning water to all areas of the filter net 361 in 1 cycle of the rotation motion of the filter net 361, the plurality of nozzles 375 include a nozzle group (not shown) configured by nozzles for spraying cleaning water to a minimum 1 radial part of the edge frame 363*a*. Hereinafter, arrangement of the nozzle group will be described in detail.

The edge frame 363*a* includes a driven gear 365 formed around the edge frame 363*a*. The driven gear 365 is configured where a plurality of saw teeth are spaced apart from each other by a predetermined distance to be formed around the edge frame 363*a*.

Although a protrusion direction of the driven gear 365 may be an upward, downward, or outward direction of the edge frame 363*a*, the driven gear 365 according to the present embodiment protrudes in a direction of a rotation axis of the rotation motion from the edge frame 363*a*.

The filter driving unit 380 includes a worm gear 383 (driven gear) disposed at an inward direction of the driven gear 365 and meshing with the driven gear 365. The filter driving unit 380 includes a motor 381 configured to rotate the worm gear 383. The rotation motion of the motor 381 is converted into a rotation motion of the edge frame 363*a*.

Since the driven gear 365 protrudes ton an inward direction of the edge frame 363*a* and the worm gear 383 is disposed in an inward direction of the driven gear 365, the worm gear 383 coheres at the driven gear 365 to apply force to an outward side, it is difficult to modify an edge frame 363*a*.

The filter net 361 is supported by a filter net fixing part 364 which is formed along an inner peripheral surface of the edge frame 363*a*. The filter net fixing part 364 is formed at a lower side of the circulation passage 40 on the inner peripheral surface of the edge frame 363*a*. That is, the filter net fixing part 364 is formed at a lower side on the inner peripheral surface of the edge frame 363*a*. The filter net fixing part 364 protrudes to a direction of the rotation axis from the edge frame 363*a* and has a rib shape extending to a direction of the edge frame 363*a*. A periphery of the filter net 361 is fixed to a protrusion end of the rib shape.

It is preferred that the driven gear 365 and the worm gear 383 are disposed at a lower side of the circulation passage 40 with respect to the filter net 361. That is, it is preferred the driven gear 365 and the worm gear 383 are disposed at a top side with respect to the filter net 361. In detail, on the inner peripheral surface of the edge frame 363*a*, a filter net 361 is disposed at a lower side being the upper side, and the driven gear 365 protrudes to a direction of the rotation axis from a top side being the lower side. Accordingly, on the circulation passage 40, foreign substances included in air are filtered by a filter net 361 of the upper side so that foreign substances may not be caught at the driven gear 365 and the worm gear 383.

The nozzle disposition part 370 disposed at a direction of a surface on which the driven gear 365 is arranged of directions of both surfaces of the filter net 361. A nozzle 376 for spraying cleaning water to the driven gear 365 is provided at the nozzle disposition part 370. The nozzle 376 is formed at a top side of the driven gear 365 on a bottom surface of the nozzle disposition part 370. The nozzle 376 may be formed at an extension line of a direction in which the plurality of nozzles 375 is arranged. Accordingly, even if foreign substances are collected in the driven gear 365, the foreign substances collected in the driven gear 365 may be removed by cleaning water sprayed from the nozzles 376.

The motor 381 includes a rotating motor shaft. The worm gear 383 is coupled with the motor shaft and the driven gear 365 is meshed with the worm gear 383. If the motor 381 rotates the motor shaft, the worm gear 383 is rotated and then the edge frame 363*a* coupled with the driven gear 365 is rotated on a plane along the filter frame guide 367. A rotation direction of the edge frame 363*a* may be changed according to a rotation direction of the motor 381.

It is preferred that a rotation direction of the motor 382 is reversely changed if resistance greater than a predetermined reference occurs upon rotation of the motor. Due to reasons such as a case where foreign substances are inserted between the worm gear 383 and the driven gear 365 or between the edge frame 363*a* and the filter frame guide 367, great resistance may be generated in rotation of the edge frame 363*a*. In this case, if the motor 381 continuously rotates the edge frame 363*a* in the same direction, the foreign substances are firmly inserted so that the rotation motion of the edge frame 303*a* may stop. In order to prevent the above, if the great resistance is generated, the motor 381 changes the rotation direction in itself and changes the rotation direction of the edge frame 363*a*.

It is preferred that the filter driving unit 380 and the driven gear 365 are provided so that the edge frame 363*a* is rotated at speed in the range of 1 rpm to 6 rpm. The motor 381 is a constant speed motor to rotate a motor shaft at constant speed. The number of saw teeth of the worm gear 383 and the driven gear 365 are controlled with respect to a rotation speed of the motor shaft so that the edge frame 363*a* is rotated at speed of 1 rpm to 6 rpm. If the edge frame 363*a* is rotated at speed of 1 rpm to 6 rpm, the cleaning water may sufficiently shock the filter net 361.

The brush 90 is disposed at a radial direction of the edge frame 363*a*. The brush 90 makes contact with a lower surface being an upper side of the filter net 361. The brush 90 is disposed at a direction in which the plurality of nozzles 375 is arranged. That is, the brush 90 makes contact with the filter net 361 along a collision region of the sprayed cleaning water with the filter net 361. One end of the brush arm 92 is fixed to an inner surface of the circulation passage 40. The brush arm 92 extends in a direction of the rotation axis from the end thereof. Another end of the brush arm 92 is provided to become a free end. A brush fixing part 91 for fixing a lower portion of the brush 90 is provided at an extension direction of the brush arm 92.

When the edge frame 363*a* performs the rotation motion, the brush 90 sweeps a bottom surface of the filter net 361. Foreign substances collected in a lower side surface of the filter net 361 are dropped in a downward direction due to gravity or adhere to the brush 90. When cleaning water from the plurality of nozzles 375 are sprayed to the brush 90, foreign substances adhering to the brush 90 may be easily removed. Since the brush 90 makes contact with the filter net 361 along a collision region of the cleaning water sprayed from the plurality of nozzles 361 with the filter net 361, the sprayed cleaning water may shock the brush 90 to easily remove the adhered foreign substances.

Referring to FIG. 10, a G arrow direction is a flow direction of cleaning water before the cleaning water is sprayed from the nozzle 375. The cleaning water introduced into the nozzle water supply passage 374 through the nozzle water supply hose 372, is sprayed toward the filter net 361 through the nozzle 376 and the plurality of nozzles 375. The sprayed cleaning water collides with the filter net 361 and the brush 90. A flow direction F of the cleaning water after spraying is as described above. The edge frame 363*a* is controlled to perform a rotation motion during spraying the cleaning water.

Figure 11:
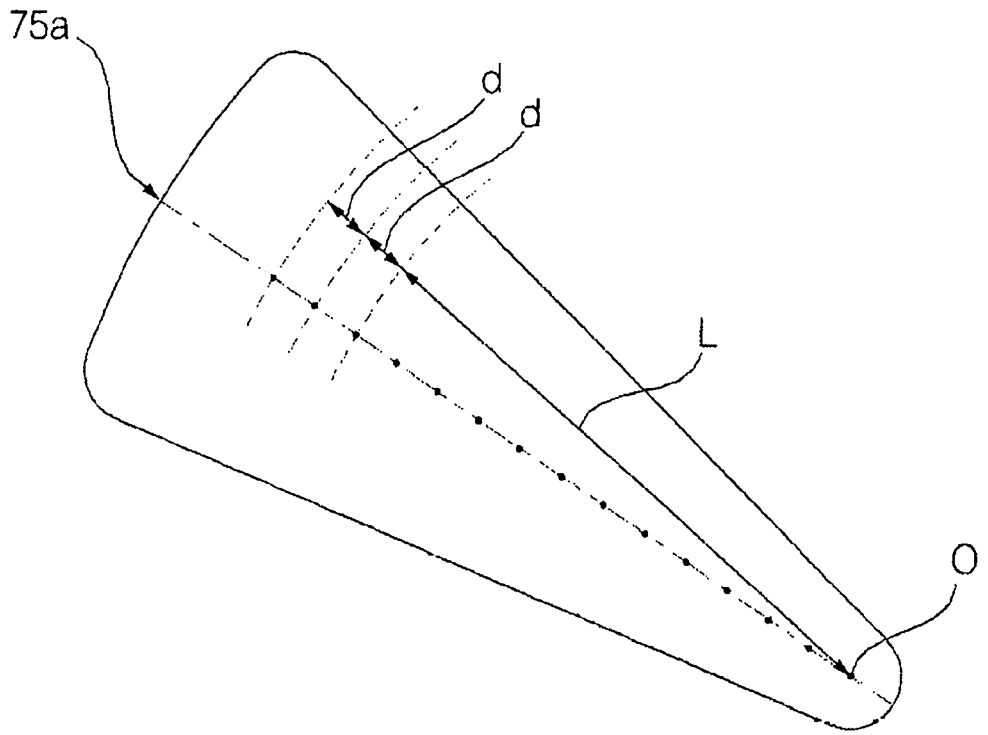
FIG. 11 is a rear view illustrating a nozzle disposition part 370 which shows an arrangement example of a plurality of nozzles 375 according to a fifth embodiment.
Figure 12:
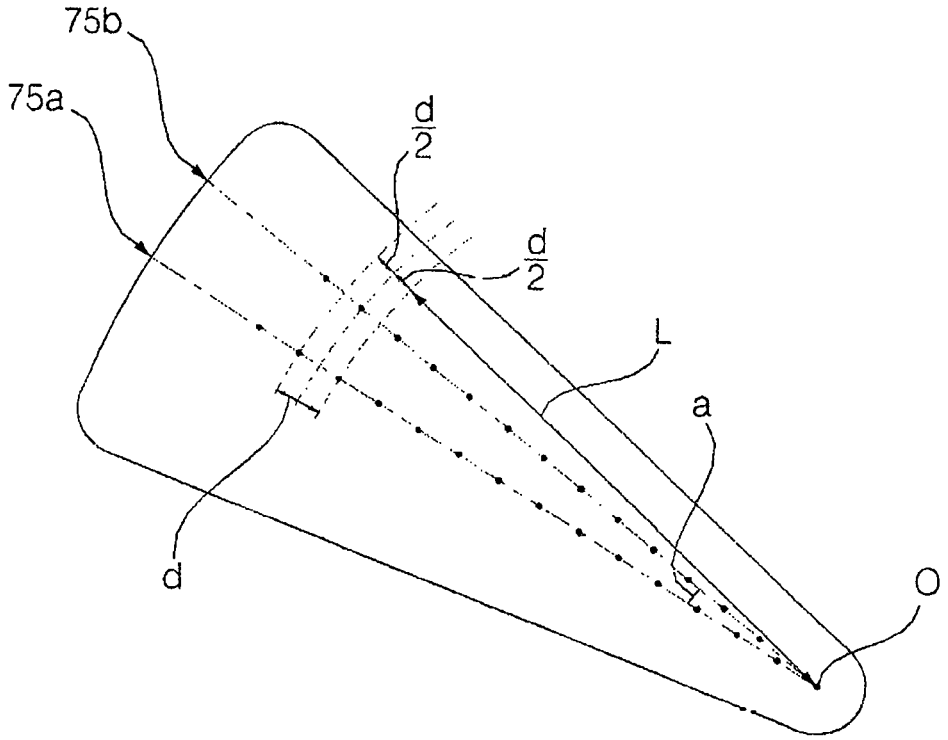
FIG. 12 is a rear view illustrating a nozzle disposition part 370 which shows an arrangement example of a plurality of nozzles 375 according to a sixth embodiment.
Figure 13:
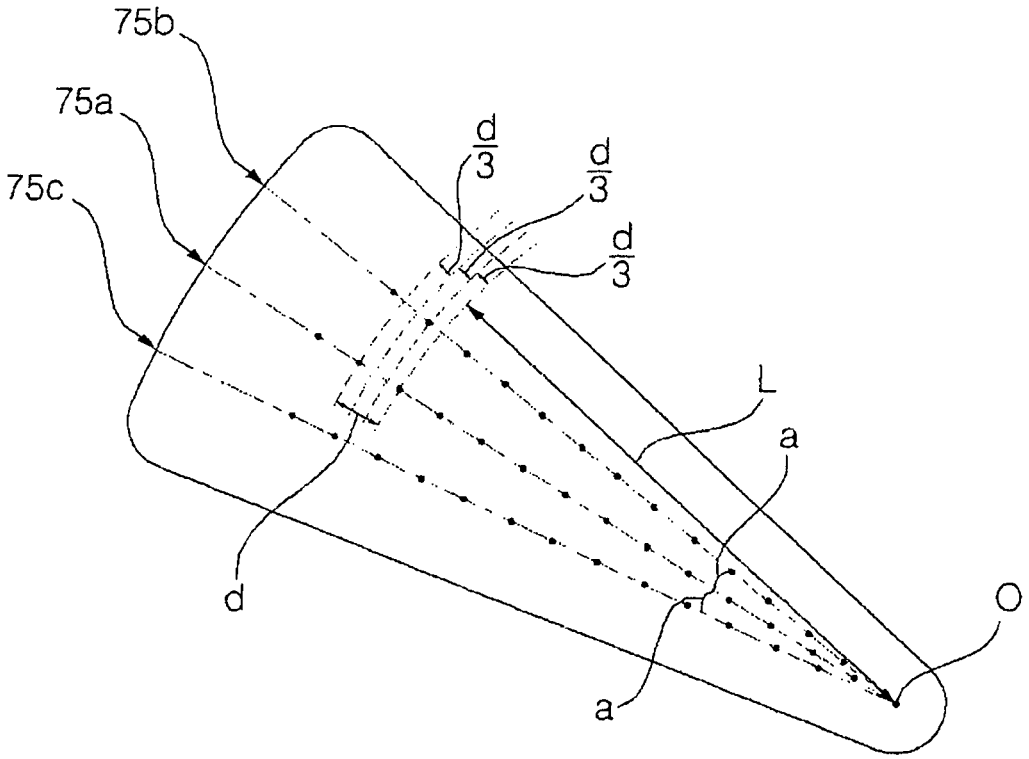
FIG. 13 is a rear view illustrating a nozzle disposition part 370 which shows an arrangement example of a plurality of nozzles 375 according to a seventh embodiment.

Hereinafter, an arrangement example of the plurality of nozzles 375 will be described with reference to FIG. 11 to FIG. 13. FIG. 11 is a rear view illustrating a nozzle disposition part 370 which shows an arrangement example of a plurality of nozzles 375 according to a fifth embodiment. FIG. 12 is a rear view illustrating a nozzle disposition part 370 which shows an arrangement example of a plurality of nozzles 375 according to a sixth embodiment. FIG. 13 is a rear view illustrating a nozzle disposition part 370 which shows an arrangement example of a plurality of nozzles 375 according to a seventh embodiment. FIG. 11 to FIG. 13 shows a point through which a rotation axis of the rotation motion virtually passes as O.

For clarity, distances between nozzles of a first nozzle group 75*a* and the rotation axis O are defined as reference values L, respectively. Since corresponding reference values L by the nozzles configuring the first nozzle group 75*a* are calculated, the reference values L are defined as a plurality of values. Respective reference values L have a difference corresponding to a multiple of a predetermined distance d. FIG. 11 to FIG. 13 show a reference value L corresponding to one nozzle among the reference values L.

The plurality of nozzles 375 includes a first nozzle group 75*a* having nozzles which are spaced apart from each other in one radial direction of the edge frame 363*a* on a rear surface of the nozzle disposition part 370. The nozzles of the first nozzle group 75*a* are spaced apart from each other by a predetermined distance d on a virtual line formed in a radial direction based on the rotation axis O. If the predetermined distance d is reduced, the cleaning water may collide with a surface of the filter net 361.

Referring to FIG. 11, a fifth embodiment is an embodiment where there is no addition nozzle group except for the first nozzle group 75*a*.

Although the filter net 361 performs a rotation motion, it is difficult to directly collide cleaning water with a surface region of the filter net 361 corresponding to a predetermined distance d region between one nozzle and another nozzle of the first nozzle group 75*a*. In order to directly collide the cleaning water with a surface region of the filter net 361 corresponding to the predetermined distance d region, the plurality of nozzles 375 may include an additional nozzle group.

Referring to FIG. 12, a sixth embodiment is an embodiment where a first nozzle group 75*a* and a second nozzle group 75*b* are arranged and there is no addition nozzle group except for the first nozzle group 75*a* and the second nozzle group 75*b*. The plurality of nozzles 375 includes a second nozzle group 75*b* arranged in another radial direction of the edge frame 363*a* forming an angle a with one radial direction on the nozzle disposition part 370. The second nozzle group 75*b* includes nozzles arranged at a position distant from the rotation axis O by a distance L+d/2 obtained by summing respective reference values L and half of the predetermined distance d. When the filter net 361 performs a rotation motion to spray the cleaning water, the second nozzle group 75*b* sprays the cleaning water to a surface region of the filter net 361 corresponding to a two halves point of the predetermined distanced of the first nozzle group 75*a*.

In order to enlarge the above concept, the following is described by defining n as a natural number of 3 or more, and a value obtained by dividing the predetermined distance d by n as an equal value d/n. The plurality of nozzles 375 includes a second nozzle group 75*b* to a n-th nozzle group in different radial directions of the edge frame 363*a* forming an angle a with one radial direction of the first nozzle group 75*a* on a bottom surface of the nozzle disposition part 370. Arrangement directions of the first nozzle group 75*a* to the n-th nozzle group form an angle a with each other. The second nozzle group 75*b* includes nozzles arranged at a position distant from the rotation axis O by a distance L+1*d/n obtained by summing respective reference values L and one multiple of the equal value d/n. The n-th nozzle group includes nozzles arranged at a position distant from the rotation axis O by a distance L+(n−1)*d/n obtained by summing respective reference values L and (n−1) multiple of the equal value d/n.

In detail, when n=3, the plurality of nozzles 375 include a first nozzle group 75*a*, a second nozzle group 75*b*, and a third nozzle group 75*c*. When n=4, a fourth nozzle group (not shown) is additionally arranged and the plurality of nozzles 375 includes a first nozzle group 75*a* to a fourth nozzle group. When n=5, a fifth nozzle group (not shown) is additionally arranged and the plurality of nozzles 375 includes a first nozzle group 75*a* to a fifth nozzle group. By enlarging the concept as described above, the plurality of nozzles 375 includes the first nozzle group 75*a* to an n-th nozzle group. When the filter net 361 performs the rotation motion to spray cleaning water, the second nozzle group 75*b* to the n-th nozzle group spray the cleaning water to a surface region of the filter net 361 corresponding to an n equal division point of a predetermined distance d of the first nozzle group 75*a*.

Referring to FIG. 13, a seventh embodiment is an embodiment where the first nozzle group 75*a* to the third nozzle group 75*c* are arranged and there is no additional nozzle group. The plurality of nozzles 375 includes the second nozzle group 75*b* to the third nozzle group 75*c* arranged in different radial directions of the edge frame 363*a* forming an angle a with one radial direction of the first nozzle group 75*a* on a bottom surface of the nozzle disposition part 370. Arrangement directions of the first nozzle group 75*a* to the third nozzle group 75*c* form an angle a with each other. The second nozzle group 75*b* includes nozzles arranged at a position distant from the rotation axis O by a distance L+1*d/3 obtained by summing respective reference values L and one multiple of the equal value d/3. The third nozzle group 75*c* includes nozzles arranged at a position distant from the rotation axis O by a distance L+2*d/n obtained by summing respective reference values L and two multiple of the equal value d/3.

Figure 14:
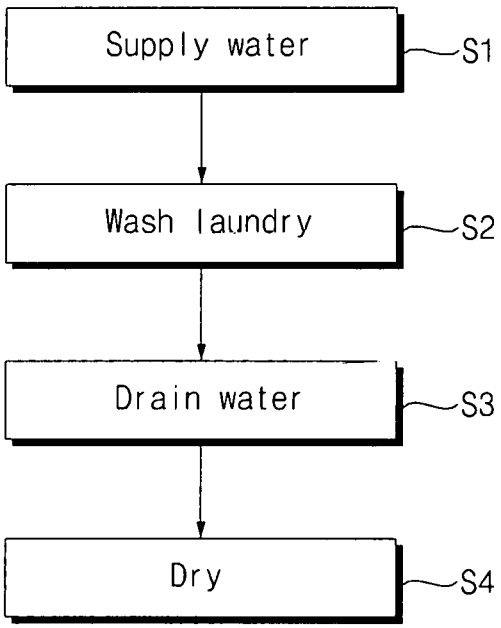
FIG. 14 is a flowchart illustrating a method for controlling a laundry treatment apparatus according to an embodiment of the present invention.

Hereinafter, a method for controlling the washing machine will be described. FIG. 14 is a flowchart illustrating a method for controlling a laundry treatment apparatus according to an embodiment of the present invention.

The control method includes a water supplying step S1 of supplying wash water into the outer tube 10. A water supply valve 21 closed at the water supplying step S1 is open. Water is moved to a detergent supply part 25 from the water source provided outside the cabinet 1 through a water supply passage 23. The water moved to the detergent supply part 25 is supplied into the outer tub 5 through an outer tub supply pipe 27.

The water supply step S1 is performed at an early stage of a wash stroke or a rinse stroke. In a case of the wash stroke, detergent included in the detergent supply part 25 is introduced into the outer tub 5 together with the wash water.

The control method includes a laundry washing step S2 for washing or rinsing laundry in the inner tub 10 by using the wash water introduced into the outer tub 5 after the water supply step S1. In the laundry washing step S2, an inner tub 10 is rotated to wash or rinse laundry in the inner tub 10. The laundry washing step S2 and the water supply step S1 may be simultaneously performed. In the laundry washing step S2, foreign substances separated from the laundry float in the wash water inside the outer tub 5.

The control method includes a water draining step S3 after the laundry washing step S2. In the water draining step S3, the wash water inside the outer tub 5 is drained through a water drain passage 30. Simultaneously, in the water draining step S3, the cleaning water is controlled to be drained together with the wash water through the water drain passage while controlling the cleaning water to be sprayed through the plurality of nozzles 175, 275, and 375 and be drained through the water drain passage 30. In the water draining step S3, a water drain pump 33 is controlled to be operated, and the filter driving unit controls the filer unit 60 and the nozzle disposition part 70 to move relative to one another.

In the water draining step S3, the cleaning water is introduced into the nozzle disposition part 70 through nozzle water supply hoses 172, 272, and 372, and the cleaning water is sprayed to the filter nets 161, 261, and 361 through a plurality of nozzles 175, 275, and 375. Next, the sprayed cleaning water passes through the filter nets 161, 261, and 361 while cleaning the filter nets 161, 261, and 361 and/or the brush 90. The cleaning water containing the foreign substances separated from the filter nets 161, 261, and 361 and/or the brush 90 is drained to the outside in the above F arrow direction of FIG. 4 by gravity.

In the water draining step S3, it is previously set that the cleaning water is sprayed through a plurality of nozzles 175, 275, and 375 while performing the relative motion, a collision part of the cleaning water with the filter nets 161, 261, and 361 is formed in a line to traverse the relative motion track. In this case, it is previously set that the sprayed cleaning water collides with partial areas of the filter nets 161, 261, and 361 but the cleaning water is sprayed to the entire area of the filter nets 161, 261, and 361 by performing the relative motion of one cycle.

In a case of the third embodiment, in the water draining step, it is previously set that the cleaning water is sprayed while performing the rotation motion for the edge frame 363*a*, and the collision art of the cleaning water with the filter net 361 is formed in a line to traverse a radius of the edge frame 363*a*. In this case, it is previously set that the sprayed cleaning water collides with a partial area of the filter net 361 but the cleaning water is sprayed to the entire area of the filter net 361 by performing the rotation motion of one cycle.

In a case of the third embodiment, the control method includes a dry step S4 of performing the rotation motion for the edge frame 363*a* while circulating air through a circulation passage 40. The dry step S4 may be performed after the water draining step S3.

In the dry step S4, air is controlled to be circulated through a circulation passage 40 by operating a fan 50. In the dry step S4, air moving on the circulation passage 40 is heated and dehumidified by operating the temperature and humidity controller. In the dry step S4, the edge frame 363*a* is controlled so that the rotation motion is performed by operating a filter driving unit 380.

If the edge frame 363*a* is rotated, foreign substances of a top surface of the filter net 361 are separated from a bottom side being the upper side of the filter net 361 by a brush 90 making contact with the filter net 361. In this case, a significant amount of the foreign substances separated from the filter net 361 are collected in the brush 90.

It is preferred that the brush 90 makes contact with the filter net 361 along a collision region of the cleaning water with the filter net 361 by spraying the cleaning water to the filter net. In this case, in the water draining step S3, the foreign substances collected in the brush 90 may be controlled to be removed by spraying the cleaning water through a plurality of nozzles 375.

Figure 15:
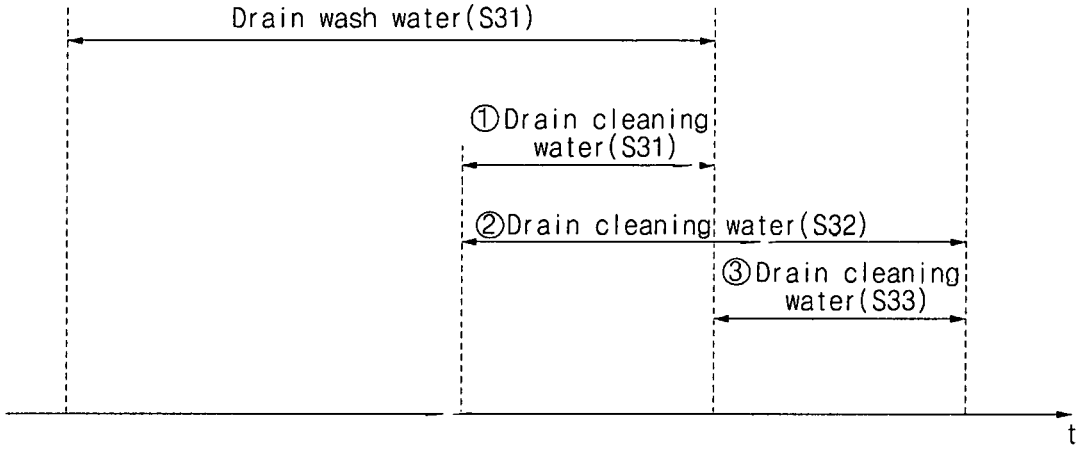
FIG. 15 is a time axis (t) sequence diagram illustrating a detailed stroke start and end time points of a water drain step S3 shown in FIG. 14.

Hereinafter, a drain start point of the cleaning water is described with reference to FIG. 15. FIG. 15 is a time axis (t) sequence diagram illustrating a detailed stroke start and end time points of a water drain step S3 shown in FIG. 14.

In the water draining step S3, as described above, in order to prevent foreign substances separated from the filter nets 161, 261, and 361 from being mixed and introduced into the inner tub 5, spray of the cleaning water may be controlled to start to the plurality of nozzles a time point when the water lever is less than the lowermost region of the inner tub 10.

In the water draining step S3, a first time point of starting drain of the cleaning water and a second time point of starting spray of the cleaning water are defined. In this case, the second time point is later than the first time point. That is why it takes a predetermined time from a water level inside the outer tub 5 to a water level H of FIG. 4 after the first time point of starting drain of the cleaning water filled inside the outer tub 5.

Referring to FIG. 15, in an embodiment, after a drain stroke S31 of wash water is terminated after the first time point, a drain stroke S33 of cleaning water may be controlled to start. In this case, the second time point is a termination time point of the drain S31 stroke of wash water.

Referring to FIG. 15, in another embodiment, a drain stroke S31 and S32 of cleaning water may be controlled to start when a water level inside the outer tub 5 after the first time point becomes the water level H of FIG. 4. In this case, the second time point is a time point when a water level inside the outer tub 5 during the drain stroke S31 of the cleaning water becomes the water level of FIG. 4. In this case, the drain stroke S31 and S32 of cleaning water may be terminated similar to the drain stroke S31 of wash water (S31), and may be terminated (S32) after the drain stroke S31 of wash water is terminated.

That is, a difference between the first time point and the second time point may be preset as a value greater than a predetermined time taken when a water level inside the outer tub 5 after the first time point becomes the lowermost region of the inner tub 10.

Although embodiments have been described with reference to a number of illustrative embodiments thereof, it should be understood that numerous other modifications and embodiments can be devised by those skilled in the art that will fall within the spirit and scope of the principles of this disclosure.

The invention claimed is:

1. A laundry handling apparatus comprising:

a cabinet;

an outer tub disposed inside the cabinet;

an inner tub rotatably disposed inside the outer tub;

a circulation passage configured to guide at least some air inside the outer tub to flow out of the outer tub and be resupplied to the outer tub;

a fan disposed in the circulation passage and configured to move the air;

a filter unit comprising:

a filter net that is disposed in the circulation passage and that is configured to collect foreign substances contained in the moving air, and a filter frame that supports the filter net;

a brush disposed at a lower side with respect to the filter net and configured to contact the filter net in a direction transverse to a motion track of the filter net;

a plurality of nozzles configured to spray wash water onto the filter net;

a nozzle disposition unit that is disposed at an upper side with respect to the filter net and located in a position spaced apart from the filter net and that has the plurality of nozzles arranged therein;

a nozzle water supply hose that is connected to the nozzle disposition unit and that is configured to supply the wash water to the plurality of nozzles; and a filter driving unit that allows the filter unit and the nozzle disposition unit to move relative to each other, wherein the brush is configured to contact a region of the filter net that is sprayed by the wash water through the plurality of nozzles.

2. The laundry handling apparatus of claim 1, wherein the plurality of nozzles are disposed in a direction transverse to a track of the relative motion.

3. The laundry handling apparatus of claim 1, wherein the circulation passage comprises a section that upwardly extends from an upper side to a lower side, the upper side and the lower side being defined based on a flow direction of air inside the circulation passage, the filter net is disposed to laterally traverse the upwardly extending section of the circulation passage, the nozzle disposition unit is disposed at a top side of the filter net, and the plurality of nozzles are provided at a bottom surface of the nozzle disposition unit and are configured to spray the wash water.

4. The laundry handling apparatus of claim 1, wherein the nozzle disposition unit is fixed, and the filter driving unit is configured to move the filter unit.

5. The laundry handling apparatus of claim 1, wherein the nozzle disposition unit is disposed at a lower side with respect to the filter net, and the brush is disposed at a lower side with respect to the filter net.

6. The laundry handling apparatus of claim 1, wherein the nozzle disposition unit is disposed at a lower side with respect to the filter net.

7. The laundry handling apparatus of claim 4, wherein the filter frame comprises an edge frame configured to support the filter net along a periphery of the edge frame, and the filter driving unit allows the edge frame to perform a rotation motion.

8. The laundry handling apparatus of claim 7, wherein the nozzle disposition unit protrudes in a direction of a rotation axis of the rotation motion from a part of the periphery of the edge frame, and the plurality of nozzles comprise a first nozzle group comprising nozzles spaced apart from each other in one radial direction of the edge frame on the nozzle disposition unit.

9. The laundry handling apparatus of claim 8, wherein the nozzles of the first nozzle group are spaced apart from each other by a predetermined distance (d), and when distances between the nozzles of the first nozzle group and the rotation axis (O) are defined as reference values (L), respectively, the plurality of nozzles comprise a second nozzle group comprising nozzles arranged at a position distant from the rotation axis (O) by a distance (L)+(d)/2 obtained by summing respective reference values (L) and half of the predetermined distance (d), in another radial direction of the edge frame forming an angle (a) with one radial direction on the nozzle disposition unit.

10. The laundry handling apparatus of claim 8, wherein the nozzles of the first nozzle group are spaced apart from each other by a predetermined distance (d), and when n is defined as a natural number of 3 or more, and a value obtained by dividing the predetermined distance (d) is defined by (n) as an equal value (d/n), and distances between the nozzles of the first nozzle group and the rotation axis (O) are defined as reference values (L), respectively, the plurality of nozzles comprise a (n)-th nozzle group configured by nozzles arranged at a position distant from the rotation axis (O) by a distance (L)+(n−1)*(d/n) obtained by summing respective reference values (L) and (n−1) multiple of the equal value (d/n), in different radial directions of the edge frame forming an angle (a) with one radial direction on the nozzle disposition unit.

11. The laundry handling apparatus of claim 7, wherein the edge frame comprises a driven gear formed along the periphery of the edge frame, the filter driving unit comprises: a worm gear meshing with the driven gear; and a motor configured to rotate the worm gear, the nozzle disposition unit is disposed at a side of the filter net facing the driven gear, and the nozzle disposition unit comprises a nozzle configured to spray wash water to the driven gear.

12. The laundry handling apparatus of claim 7, wherein the edge frame comprises a driven gear protruding in a direction of a rotation axis of the rotation motion along the periphery of the edge frame, and the filter driving unit comprises: a worm gear meshing with the driven gear; and a motor configured to rotate the worm gear.

13. The laundry handling apparatus of claim 7, wherein the edge frame comprises a driven gear formed along the periphery of the edge frame, the filter driving unit comprises: a worm gear meshing with the driven gear; and a motor configured to rotate the worm gear, and the driven gear and the worm gear are disposed at a lower side with respect to the filter net.

14. The laundry handling apparatus of claim 11, wherein a rotation direction of the motor is reversely changed if resistance greater than a predetermined reference occurs upon rotation of the motor.

15. The laundry handling apparatus of claim 7, wherein the edge frame comprises a driven gear formed along the periphery of the edge frame, the filter driving unit comprises: a worm gear meshing with the driven gear; and a motor configured to rotate the worm gear, and the filter driving unit and the driven gear are provided so that the edge frame is rotated at speed in the range of 1 rpm to 6 rpm.

* * * * *